US008034526B2

(12) United States Patent
Watanabe et al.

(10) Patent No.: US 8,034,526 B2
(45) Date of Patent: Oct. 11, 2011

(54) METHOD FOR MANUFACTURING TONER AND TONER

(75) Inventors: Yohichiroh Watanabe, Fuji (JP); Shinji Ohtani, Shizuoka (JP); Yoshihiro Norikane, Yokohama (JP); Yasuaki Iwamoto, Numazu (JP); Yasutada Shitara, Numazu (JP); Kazumi Suzuki, Shizuoka (JP); Takahiro Honda, Fujinomiya (JP)

(73) Assignee: Ricoh Company Limited, Tokyo (JP)

( * ) Notice: Subject to any disclaimer, the term of this patent is extended or adjusted under 35 U.S.C. 154(b) by 969 days.

(21) Appl. No.: 11/851,475

(22) Filed: Sep. 7, 2007

(65) Prior Publication Data

US 2008/0063971 A1 Mar. 13, 2008

(30) Foreign Application Priority Data

Sep. 7, 2006 (JP) ..... 2006-242287
Jul. 13, 2007 (JP) ..... 2007-184330

(51) Int. Cl.
*G03G 9/08* (2006.01)

(52) U.S. Cl. ..... 430/137.1; 430/108.4

(58) Field of Classification Search ..... 430/137.1, 430/108.4

See application file for complete search history.

(56) References Cited

U.S. PATENT DOCUMENTS 4,841,331 A 6/1989 Nakayama et al.
4,908,290 A 3/1990 Watanabe et al.
4,945,022 A 7/1990 Nakayama et al.
4,956,258 A 9/1990 Watanabe et al.
4,980,258 A 12/1990 Aoki et al.
5,225,303 A 7/1993 Tomita et al.
5,229,242 A * 7/1993 Mahabadi et al. ..... 430/108.8
5,288,577 A 2/1994 Yamaguchi et al.
5,314,777 A 5/1994 Watanabe et al.
5,368,972 A 11/1994 Yamashita et al.
5,384,226 A * 1/1995 Kanakura et al. ..... 430/137.15
5,418,103 A 5/1995 Muto et al.
5,429,901 A 7/1995 Muto et al.
5,476,744 A * 12/1995 Anno ..... 430/137.19
5,514,511 A 5/1996 Iwamoto et al.

(Continued)

FOREIGN PATENT DOCUMENTS

JP 52-3304 1/1977

(Continued)

OTHER PUBLICATIONS

U.S. Appl. No. 12/264,299, filed Nov. 4, 2008, Watanabe et al.

(Continued)

*Primary Examiner* — Christopher Rodee
(74) *Attorney, Agent, or Firm* — Oblon, Spivak, McClelland, Maier & Neustadt, L.L.P.

(57) ABSTRACT

A method for manufacturing a toner, including: dissolving or dispersing toner constituents including a resin, a colorant, a release agent, and a graft polymer including a polyolefin resin unit and a vinyl resin unit in a solvent, to prepare a toner constituent liquid; supplying the toner constituent liquid to a retention part configured to retain the toner constituent liquid; discharging the toner constituent liquid from the retention part to a granulation space through plural holes arranged on the retention part, while exciting the toner constituent liquid by a vibration means in contact with a part of the retention part, so that the discharged columnar toner constituent liquid is constricted to form liquid droplets; and converting the liquid droplets into solid toner particles; together with a toner manufactured by the above method.

27 Claims, 13 Drawing Sheets

U.S. PATENT DOCUMENTS 5,750,299 A 5/1998 Ohshima et al.
5,840,456 A 11/1998 Tomita et al.
5,994,017 A * 11/1999 Lin ..... 430/108.4
6,074,795 A 6/2000 Watanabe et al.
6,103,441 A 8/2000 Tomita et al.
6,180,298 B1 1/2001 Kuroda et al.
6,183,926 B1 2/2001 Kuroda et al.
6,258,502 B1 7/2001 Nakamura et al.
6,303,257 B1 10/2001 Hasegawa et al.
6,363,229 B1 3/2002 Shiraishi et al.
6,368,765 B2 4/2002 Izu et al.
6,468,706 B2 10/2002 Matsuda et al.
6,503,681 B2 1/2003 Makino et al.
6,544,704 B1 4/2003 Matsuda et al.
6,566,026 B2 5/2003 Watanabe et al.
6,593,048 B2 7/2003 Sasaki et al.
6,653,037 B2 11/2003 Sawada et al.
6,667,141 B2 12/2003 Iwamoto et al.
6,699,632 B2 3/2004 Higuchi et al.
6,716,561 B2 4/2004 Shiraishi et al.
6,790,575 B2 9/2004 Sasaki et al.
6,811,944 B2 11/2004 Higuchi et al.
6,813,461 B2 11/2004 Higuchi et al.
6,821,698 B2 11/2004 Sawada et al.
6,830,859 B2 12/2004 Shiraishi et al.
6,835,517 B2 12/2004 Kondo et al.
6,852,459 B2 2/2005 Katoh et al.
6,856,781 B2 2/2005 Matsuda et al.
6,858,365 B2 2/2005 Sawada et al.
6,911,289 B2 6/2005 Higuchi et al.
6,939,653 B2 9/2005 Suzuki et al.
6,946,229 B2 9/2005 Suzuki et al.
6,977,129 B2 12/2005 Saito et al.
7,029,816 B2 4/2006 Sasaki et al.
7,049,037 B2 5/2006 Katoh et al.
7,052,815 B2 5/2006 Sawada et al.
7,074,535 B2 7/2006 Saito et al.
7,074,541 B2 7/2006 Yamashita et al.
7,122,286 B2 10/2006 Suzuki et al.
7,132,210 B2 11/2006 Suzuki et al.
7,163,773 B2 1/2007 Sugiura et al.
7,166,403 B2 1/2007 Ichikawa et al.
7,169,525 B2 1/2007 Sugiura et al.
7,172,844 B2 2/2007 Umemura et al.
7,198,874 B2 4/2007 Saito et al.
7,241,548 B2 7/2007 Sugiyama et al.
7,258,959 B2 8/2007 Nakayama et al.
7,261,989 B2 8/2007 Sugiura et al.
2002/0039698 A1 4/2002 Sasaki et al.
2003/0152857 A1 8/2003 Sugiura et al.
2003/0190543 A1 10/2003 Sugiura et al.
2004/0115551 A1 6/2004 Sugiyama et al.
2004/0131961 A1 7/2004 Watanabe et al.
2004/0259013 A1 12/2004 Ohtani et al.
2005/0026064 A1 2/2005 Sugiura et al.
2005/0079433 A1 4/2005 Watanabe et al.
2005/0089786 A1 4/2005 Sugiura et al.
2005/0089787 A1 4/2005 Uchinokura et al.
2005/0158648 A1 * 7/2005 Makino et al. ..... 430/110.4
2005/0180786 A1 8/2005 Yamada et al.
2005/0191575 A1 9/2005 Sugiura et al.
2005/0196691 A1 9/2005 Ohtani et al.
2005/0205536 A1 9/2005 Norikane et al.
2005/0208408 A1 9/2005 Uchinokura et al.
2005/0277046 A1 12/2005 Sawada et al.
2006/0056888 A1 3/2006 Sugiyama et al.
2006/0068312 A1 3/2006 Yamashita et al.
2006/0127788 A1 6/2006 Yamashita et al.
2006/0160011 A1 7/2006 Inoue et al.
2006/0165989 A1 7/2006 Takikawa et al.
2006/0204883 A1 9/2006 Nakayama et al.
2006/0210909 A1 * 9/2006 Ohtani ..... 430/137.1
2006/0222987 A1 10/2006 Suzuki et al.
2006/0240349 A1 10/2006 Watanabe et al.
2006/0240354 A1 * 10/2006 Ohtani ..... 430/137.1
2007/0031748 A1 2/2007 Kotsugai et al.
2007/0031752 A1 2/2007 Watanabe et al.

FOREIGN PATENT DOCUMENTS

JP 4-299357 10/1992
JP 4-337737 11/1992
JP 5-341577 12/1993
JP 6-123999 5/1994
JP 6-208244 7/1994
JP 6-230600 8/1994
JP 6-295093 10/1994
JP 6-324514 11/1994
JP 7-84401 3/1995
JP 7-152202 6/1995
JP 7-82255 9/1995
JP 7-281478 10/1995
JP 8-166686 6/1996
JP 8-328293 12/1996
JP 9-258471 10/1997
JP 10-161335 6/1998
JP 11-258934 9/1999
JP 11-258935 9/1999
JP 2000-75549 3/2000
JP 2001-249485 9/2001
JP 2001-305782 11/2001
JP 2002-6541 1/2002
JP 3344003 8/2002
JP 2003-202698 7/2003
JP 2003-255589 9/2003
JP 2003-262976 9/2003
JP 2003-262977 9/2003
JP 2003-280236 10/2003
JP 2006-28432 2/2006
JP 2006-28433 2/2006
JP 2006-75708 3/2006
JP 2006-77252 3/2006
JP 2006-167593 6/2006
JP 2006-293320 10/2006
JP 3946518 4/2007
WO WO 03/000741 A1 1/2003

OTHER PUBLICATIONS

U.S. Appl. No. 12/297,952, filed Oct. 21, 2008, Iwamoto et al.
U.S. Appl. No. 12/036,706, filed Feb. 25, 2008, Suzuki et al.
U.S. Appl. No. 12/047,807, filed Mar. 13, 2008, Honda et al.
L. Rayleigh, "On the Instability of Jets", Math. Soc., vol. 110, No. 4, Nov. 14, 1878, pp. 4-13.
J.M. Schneider, et al., "Source of Uniform-Sized Liquid Droplets", The Review of Scientific Instruments, vol. 35, No. 10, Oct. 1964, pp. 1349-1350.
N. R. Lindblad, et al., "Production of Uniform-Sized Liquid Droplets", J. Sci. Instrum., vol. 42, 1965, pp. 635- 638.
U.S. Appl. No. 11/652,083.
U.S. Appl. No. 11/752,343, filed May 23, 2007, Nagatomo et al.
U.S. Appl. No. 11/755,517, filed May 30, 2007, Iwamato et al.
U.S. Appl. No. 11/738,149, filed Apr. 20, 2007, Iwamato et al.
U.S. Appl. No. 12/187,717, filed Aug. 7, 2008, Suzuki et al.

* cited by examiner

METHOD FOR MANUFACTURING TONER AND TONER

BACKGROUND OF THE INVENTION

1. Field of the Invention

The present invention relates to a method for manufacturing a toner and a toner for use in electrophotography.

2. Discussion of the Background

In electrophotography, electrostatic recording, electrostatic printing, etc., a developer is adhered to an image bearing member, such as an electrostatic latent image bearing member on which an electrostatic latent image is formed, and then transferred from the image bearing member onto a transfer medium such as a paper, and finally fixed on the paper. As the developer configured to develop the electrostatic latent image formed on the image bearing member, a two-component developer including a carrier and a toner and a one-component developer consisting essentially of a toner (e.g., magnetic toner and non-magnetic toner) are known.

As a dry toner for use in electrophotography, electrostatic recording, electrostatic printing, etc., a pulverized toner in which a toner binder such as a styrene resin and a polyester resin, a colorant, etc. are melt-kneaded and pulverized is widely used.

Recently, polymerized toners which are manufactured by polymerization methods such as suspension polymerization methods and emulsion polymerization aggregation methods are studied. Published unexamined Japanese patent application No. (hereinafter referred to as JP-A) 07-152202 discloses a polymer dissolution suspension method. In this method, toner components are dispersed and/or dissolved in a volatile solvent such as an organic solvent having a low boiling point to prepare a toner component mixture liquid. The thus prepared mixture liquid is emulsified in an aqueous medium containing a dispersant to form droplets of the mixture liquid. Finally, the volatile solvent is removed from the droplets to prepare toner particles while contracting the volume of the droplets. Unlike suspension polymerization methods and emulsion polymerization aggregation methods, the polymer dissolution suspension method has an advantage that various kinds of resins can be used. For example, a polyester resin, which is useful for obtaining a full-color image having transparency and smoothness, can be used for this method.

Since the polymerized toners are prepared in an aqueous medium containing a dispersant, the dispersant tends to remain on the surface of the toner and deteriorates chargeability and environmental stability thereof. In order to remove the remaining dispersant, a large amount of water is needed. Thus, the polymerized methods are not necessarily satisfactory.

In attempting to solve the above problems, JP-A 2003-262976 discloses a toner manufacturing method in which microdroplets of fluid raw materials are formed using piezoelectric pulse and then dried to become toner particles. JP-A 2003-280236 discloses a toner manufacturing method in which microdroplets of fluid raw materials are formed using thermal expansion of the nozzle and then dried to become toner particles. JP-A 2003-262977 discloses a toner manufacturing method in which microdroplets of fluid raw materials are formed using an acoustic lens and then dried to become toner particles. These methods have a disadvantage that manufacturability of the toner is poor because the number of the droplets discharged per unit time is small. In addition, it is difficult to prevent each of the droplets from uniting with each other, resulting in broad particle diameter distribution of the resultant particles. Thus, these methods are also not necessarily satisfactory.

JP-As 2006-28432 and 2006-28433 have disclosed methods in which a dispersion liquid, in which toner components including a light curing resin and a thermal curing resin, respectively, are dispersed in a dispersion medium, is intermittently discharged from a nozzle to form droplets, and then the droplets are aggregated while the light or thermal curing resin is cured to stably form particles. However, these methods also have poor manufacturability and the resultant particles have a wide particle diameter distribution. In addition, the cured resins do not impart satisfactory fixability to the resultant particles.

These methods have a feature that the dispersion liquid directly contacts a vibration part. In this case, when the number of holes and that of the vibration part are same, the resultant particles have a narrow particle diameter distribution. But when there are a plurality of holes and a single vibration part, the size of the droplet depends on the distance between the hole and the vibration part. Therefore, different holes produce particles having different particle diameters.

The dry toner is typically fixed on a recording medium (such as paper) upon application of heat by directly contacting a heat roller or belt. When the temperature of the heat roller or belt is too high, an offset problem tends to be caused in that excessively melted toner is adhered to the surface of the heat roller or belt. In contrast, when the temperature of the heat roller or belt is too low, the toner cannot be sufficiently fused and fixed.

In terms of energy saving and downsizing of apparatuses, a need exists for a toner which minimizes hot offset (this property is hereinafter referred to as hot offset resistance) and which can be fixed at low temperatures (this property is hereinafter referred to as low-temperature fixability). The toner is also required to have a property such that the toner does not cause a blocking problem even when the toner is stored at the temperature inside an apparatus (this property is hereinafter referred to as thermostable preservability). In particular, full-color copiers and printers are required to produce images having glossiness and color-mixing property, and therefore polyester resins are widely used as a full-color toner binder because of having low melt-viscosity.

Since such a toner easily causes hot offset, a silicone oil is typically applied to a heat member in the full-color copiers and printers. In this case, the apparatus needs an oil tank and an oil applicator, and therefore the apparatus must be larger and complicated. There is another problem such that the oil applied to the heat member tends to adhere to copier papers and overhead projection (OHP) films, resulting in deterioration of the color tone of the produced images.

In attempting to solve these problems, a technique in which a release agent (such as wax) is added to a toner is proposed and widely used to prevent the toner from adhering to the heat roller without applying an oil thereto. Releasability of the toner greatly depends upon dispersing conditions of the wax in the toner. When the wax is compatible with the binder resin used, the toner has no releasability. When the wax is incompatible with the binder resin and forms domains thereof in the toner, the toner has releasability. In this case, when the domains are too large, the amount of the wax existing near the surface of the toner relatively increases. Thereby, the toner particles tend to aggregate, resulting in deterioration of fluidity thereof. In addition, the wax tends to form films thereof on a carrier, a photoreceptor, and the like, after a long period of use, and therefore the image quality deteriorates. When the toner is a color toner, there is another problem that color reproducibility and transparency deteriorate. When the domains are too small, the wax is too excessively dispersed to impart good releasability to the toner.

Although it is necessary to control the dispersion diameter of the wax domain, there is no appropriate way. In particular, the dispersion diameter of the wax domain of the pulverized toner depends upon the shearing force applied when toner components are melt-kneaded. But it is difficult to apply a proper amount of shearing force to a polyester resin, which is widely used as a binder resin recently, due to its low viscosity. In this case, it is difficult to control the dispersion diameter of the wax domain.

In a pulverized toner, there is another problem that the wax tends to exist at pulverized sections, i.e., the wax tends to exist at the surface of the toner particles.

The wax is softer and has a larger adhesive property than the resin. Therefore, the wax tends to adhere to a photoreceptor and form a film thereof (this phenomena is hereinafter called to as filming problem) when a large amount of the wax is present at the surface of the toner.

In order to produce high definition and high quality images, toners are improved to have a smaller particle diameter and a narrower particle diameter distribution. Since conventional pulverized toner particles have irregular shapes, the toner particles tend to be excessively pulverized when mixed with a carrier in a developing device (when used for a two-component developer), or when contacting a developing roller, a toner supplying roller, a toner layer thickness controlling blade, a friction-charging blade, etc. under stress (when used for a one-component developer). As a result, the resultant image quality deteriorates because ultrafine particles are produced and a fluidizer is buried in the surfaces of the toner particles. Since such an irregular-shaped toner has poor fluidity, there is a problem that the toner needs a large amount of a fluidizer. There is another problem that a toner bottle must be larger because such an irregular-shaped toner cannot effectively fill up the toner bottle, resulting in disturbing downsizing of the apparatus.

A full-color transfer process in which a full-color toner image is transferred from a photoreceptor to a transfer medium or a paper is complicated. On the other hand, a pulverized toner has poor transferability due to its shape. When the pulverized toner is used for the full-color transfer process, the transferred image may have image defects and a large amount of the toner is consumed so as to compensate the image defects.

Therefore, there are demands for improving transferability of the toner to produce high quality images by reducing image defect and to reduce the running cost by reducing the amount of the toner consumed. If the toner has good transferability, the toner particles tend not to remain on the photoreceptor or the transfer medium, and therefore the apparatus does not need a cleaning unit. As a result, the apparatus can be downsized and the manufacturing cost thereof can be reduced. In addition, waste toner particles are not produced. In attempting to overcome the above drawbacks of the irregular-shaped toner, various methods of preparing a spherical toner have been proposed.

For example, in attempting to improve both low-temperature fixability and hot offset resistance of a toner, a technique in which a release agent (e.g., a polyolefin wax) having a low melting point is added to a toner has been proposed.

JP-A's 06-295093, 07-84401, and 09-258471 have disclosed toners including a wax having a specific endothermic peak measured by a differential scanning calorimeter (DSC). However, these toners do not sufficiently satisfy low-temperature fixability, hot offset resistance, and developability.

JP-A's 05-341577, 06-123999, 06-230600, 06-295093, and 06-324514 have disclosed toners including a release agent such as a candelilla wax, a higher fatty acid wax, a higher alcohol wax, natural plant waxes (a carnauba wax, a rice wax), and a montan ester wax. However, these toners do not sufficiently satisfy low-temperature fixability, hot offset resistance, developability (chargeability), and durability. In general, when a release agent having a low-melting point is added to a toner, fluidity of the toner deteriorates, and therefore developability, transferability, chargeability, durability, and preservability thereof also deteriorate.

JP-A's 11-258934, 11-258935, 04-299357, 04-337737, 06-208244, and 07-281478 have disclosed toners including two or more release agents so as to broaden the fixable temperature range (in which hot offset does not occur) thereof. However, these toners have a problem in dispersibility of the wax in the toner.

JP-A 08-166686 discloses a toner including a polyester resin and two offset inhibitors, each of which has an acid value and a different melting point. However, this toner has insufficient developability.

JP-A's 08-328293 and 10-161335 have disclosed toners including wax particles having a specific particle diameter. However, the existential condition and location of the wax particles are undefined, and therefore the toner has insufficient separativeness when fixed.

JP-A 2001-305782 discloses a toner, on the surface of which spherical wax particles are fixed. When the wax particles are present on the surface of the toner, fluidity thereof deteriorates, and therefore developability, transferability, chargeability, durability, and preservability also deteriorate.

JP-A 2002-6541 discloses a toner in which wax particles are locally present near the surface of the toner particle. However, hot offset resistance, preservability, and durability of the toner is not always satisfactory.

Published examined Japanese patent application Nos. (hereinafter referred to as JP-B) 52-3304 and 07-82255 have disclosed pulverized toners including a styrene resin as a binder resin, a polyolefin (such as a low-molecular weight polyethylene and a low-molecular weight polypropylene) as a release agent, and/or a polyolefin resin to which a styrene resin is grafted. Since the styrene resin does not impart low-temperature fixability to the resultant toner, these toners do not respond to a recent demand for energy saving.

JP-A's 2000-75549, 2001-249485, 2003-202698, and 2003-255589 have disclosed toners including a polyester resin which can impart low-temperature fixability to the resultant toner. These toners are pulverized toners which are prepared by melt-kneading toner components, followed by fine pulverization and classification. The shape and the surface structure of the pulverized toner depend on the pulverization property of the materials used and the pulverization condition, and it is difficult to easily control the shape and the surface structure. It is also difficult to narrow the particle diameter distribution because there is a limit to improve the classification ability and the manufacturing cost is raised. It is also difficult for the pulverized toner to have an average particle diameter of not greater than 6 μm considering yield, manufacturability, and cost.

On the other hand, in a toner manufacturing method in which toner components are discharged from a micronozzle, it is easy to form spherical particles having a smaller particle diameter. But there is a problem of nozzle clogging. In particular, when toner components include coarse particles or aggregations of a release agent, nozzle clogging easily occurs.

The present inventors have found that a toner having a nearly monodisperse particle diameter distribution can be prepared by a method including:

dissolving or dispersing toner constituents comprising a resin and a colorant in a solvent, to prepare a toner constituent liquid;

supplying the toner constituent liquid to a retention part configured to retain the toner constituent liquid;

discharging the toner constituent liquid from the retention part to a granulation space through plural holes arranged on the retention part, while exciting the toner constituent liquid by a vibration means in contact with a part of the retention part, so that the discharged columnar toner constituent liquid is constricted to form liquid droplets; and converting the liquid droplets into solid toner particles.

In this method, the single vibration means entirely excites the retention part having plural holes. Thereby, a uniform vibration is applied to the toner constituent liquid, which is to be discharged from the retention part through plural holes, and an acoustic wave is generated therein. As a result, more than 100 liquid-droplet-forming phenomena can be simultaneously performed by the single vibration part. This method can solve the conventional problems such as hole clogging, poor manufacturability, and poor stability, and is capable of efficiently producing a toner having a narrower particle diameter distribution than ever before. Such a toner has little or no variation in toner properties (such as fluidity and chargeability) among each toner particles.

However, when the toner constituent liquid includes a wax, the holes are easily clogged with the wax, and therefore the resultant toner hardly has a narrow particle diameter distribution.

SUMMARY OF THE INVENTION

Accordingly, an object of the present invention is to provide a toner manufacturing method which can efficiently produce a toner having a small particle diameter and a monodisperse particle diameter distribution.

Another object of the present invention is to provide a toner which can produce high definition and high quality images for a long period of the time.

These and other objects of the present invention, either individually or in combinations thereof, as hereinafter will become more readily apparent can be attained by a method for manufacturing a toner, comprising:

dissolving or dispersing toner constituents comprising a resin, a colorant, a release agent, and a graft polymer comprising a polyolefin resin unit and a vinyl resin unit in a solvent, to prepare a toner constituent liquid;

supplying the toner constituent liquid to a retention part configured to retain the toner constituent liquid;

discharging the toner constituent liquid from the retention part to a granulation space through plural holes arranged on the retention part, while exciting the toner constituent liquid by a vibration means in contact with a part of the retention part, so that the discharged columnar toner constituent liquid is constricted to form liquid droplets; and converting the liquid droplets into solid toner particles; another method for manufacturing a toner, comprising:

dissolving or dispersing toner constituents comprising a resin, a colorant, a release agent, and a graft polymer comprising a polyolefin resin unit and a vinyl resin unit in a solvent, to prepare a toner constituent liquid;

supplying the toner constituent liquid to a retention part configured to retain the toner constituent liquid;

periodically discharging the toner constituent liquid from the retention part through plural holes arranged on a thin film provided on the retention part, while vibrating the thin film by a mechanical vibration means, so that liquid droplets are formed; and converting the liquid droplets into solid toner particles, wherein the mechanical vibration means comprises a circular vibration generating means provided surrounding the holes arranged on the thin film; yet another method for manufacturing a toner, comprising:

dissolving or dispersing toner constituents comprising a resin, a colorant, a release agent, and a graft polymer comprising a polyolefin resin unit and a vinyl resin unit in a solvent, to prepare a toner constituent liquid;

supplying the toner constituent liquid to a retention part configured to retain the toner constituent liquid;

periodically discharging the toner constituent liquid from the retention part through plural holes arranged on a thin film provided on the retention part, while vibrating the thin film by a mechanical vibration means, so that liquid droplets are formed; and converting the liquid droplets into solid toner particles, wherein the mechanical vibration means comprises a vibration means comprising a vibrating surface provided parallel to the thin film and vibrates in a vertical direction; and toners manufactured by the above methods.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
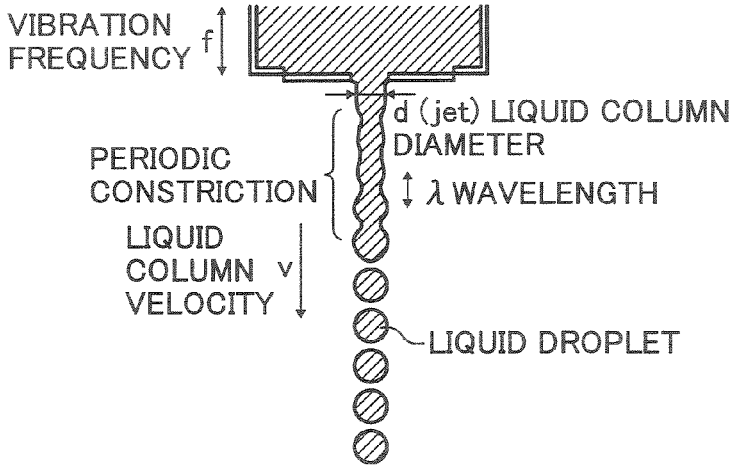
FIG. 1 is a schematic view for explaining how liquid droplets are formed.

The present inventors found out that the above problem can be solved when the toner constituent liquid includes a specific graft polymer.

A method for manufacturing a toner according to the first exemplary embodiment of the present invention includes:

dissolving or dispersing toner constituents comprising a resin, a colorant, a release agent, and a graft polymer comprising a polyolefin resin unit and a vinyl resin unit in a solvent, to prepare a toner constituent liquid;

supplying the toner constituent liquid to a retention part configured to retain the toner constituent liquid;

discharging the toner constituent liquid from the retention part to a granulation space through plural holes arranged on the retention part, while exciting the toner constituent liquid by a vibration means in contact with a part of the retention part, so that the discharged columnar toner constituent liquid is constricted to form liquid droplets; and converting the liquid droplets into solid toner particles.

In the method for manufacturing a toner according to the first exemplary embodiment of the present invention, when a toner constituent liquid is discharged from holes, a vibration is applied to the toner constituent liquid at a constant frequency. Thereby, the discharged columnar toner constituent liquid is constricted at a constant interval, resulting in forming liquid droplets having a specific volume. Thus, a spherical toner having a monodisperse particle diameter distribution can be provided. Compared with conventional pulverized toners and chemical toners, such a toner has lower variation in toner properties among the individual toner particles. Thereby, a latent image formed on a photoreceptor can be faithfully reproduced for a long period of the time.

Since the above toner has uniform particle diameter distribution, shape, and surface condition, the toner can be efficiently charged to the desired level by applying very small mechanical stress thereto. Therefore, the life of the toner is lengthened, resulting in producing high quality images for a long period of the time.

In the present invention, the toner constituent liquid includes a graft polymer including a polyolefin resin unit and a vinyl resin unit together with a release agent. Thereby, the release agent is finely dispersed and prevented from aggregating in the toner constituent liquid. As a result, hole clogging hardly occurs when the toner constituent liquid is continuously discharged from the retention part, which is in contact with the vibration means, through holes to form liquid droplets, and a toner having a narrow particle diameter distribution can be efficiently prepared.

Since such a toner prepared by the method of the present invention includes a wax which is finely dispersed by the graft polymer including a polyolefin resin unit and a vinyl resin unit, the toner has good hot offset resistance without causing migration of the release agent to the surface of the toner or filming problem in that the release agent forms a film thereof on a photoreceptor, etc. In addition, the toner also has a small particle diameter and a narrow particle diameter distribution, and therefore high quality images can be stably produced.

Further, it is preferable that the polyolefin resin has a softening point of from 70 to 150° C., the vinyl resin has an SP value of from 10.0 to 11.5, and the toner includes the graft polymer in an amount of from 10 to 150 parts by weight based on 100 parts by weight of the release agent.

FIG. 1 is a schematic view for explaining how liquid droplets are formed.

As described in a reference entitled "On the Instability of Jets (Rayleigh, Lord, Proc. London Math. Soc. 110:4 (1878))", a wavelength λ which forms the most unstable liquid column is represented by the following equation:

$$\lambda=4.5d(\text{jet}) \tag{1}$$

wherein d(jet) represents the diameter of a liquid column.

The frequency f of the generated disturbance is represented by the following equation:

$$f=v/\lambda \tag{2}$$

wherein v represents the velocity of the liquid column.

As described in a reference entitled "Source of Uniform-Sized Liquid Droplets (J. M. Schneider, C. D. Hendricks, Rev. Instrum., 35(10), 1349-50 (1964))", uniform-sized liquid droplets can be stably formed when the following relationship is satisfied:

$$3.5<\lambda/d(\text{jet})<7.0 \tag{3}$$

As described in a reference entitled "Production of uniform-sized liquid droplets (N. R. Lindblad, J. M. Schneider, J. Sci. Instrum., 42, 635 (1965))", the minimum jet velocity V(min) in which a liquid discharged from a hole forms a liquid column is represented by the following equation, based on energy conservation law:

$$V(\text{min})=(8\sigma/\rho d(\text{jet}))^{1/2} \tag{4}$$

wherein σ represents the surface tension of a liquid and ρ represents the density of the liquid.

The present inventors confirmed that the equations (1) to (4) may vary when the liquid component varies. However, the liquid-droplet-forming phenomenon is observed in various liquids when the liquid is vibrated at a frequency f by a vibration means provided in a liquid chamber.

Figure 2:
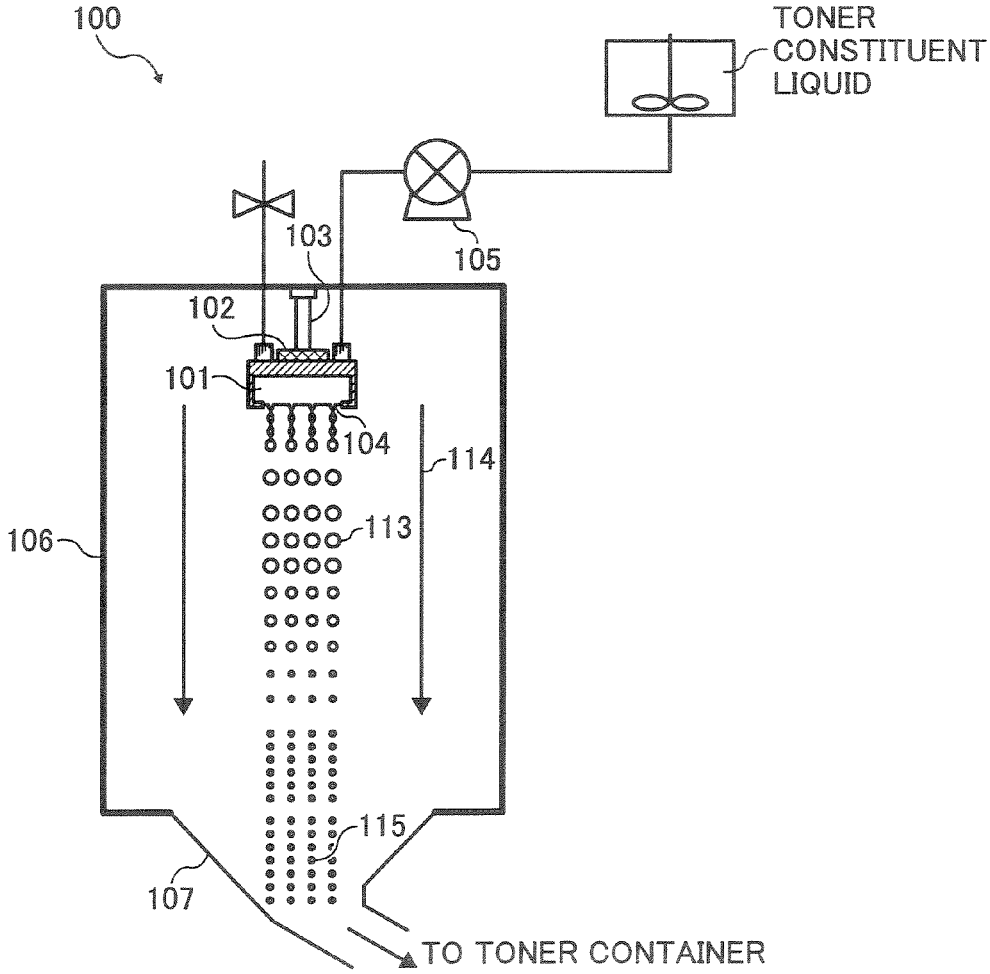
FIG. 2 is a schematic view illustrating a first exemplary embodiment of the toner manufacturing device for use in the present invention.

FIG. 2 is a schematic view illustrating a first exemplary embodiment of the toner manufacturing device for use in the present invention.

A toner manufacturing device 100 includes a liquid droplet forming means including a retention part 101 configured to retain a toner constituent liquid, a vibration means 102, a support means 103 configured to support the vibration means 102, and plural holes 104; a liquid supplying means 105 configured to supply the toner constituent liquid to the retention part 101; a solvent removing device 106; and a toner collection part 107.

The retention part 101 needs to retain the toner constituent liquid under pressure. Therefore, the retention part 101 is preferably made of a metallic material such as SUS and aluminum, and preferably has a resistance to a pressure of about 10 MPa, but is not particularly limited.

Figure 3:
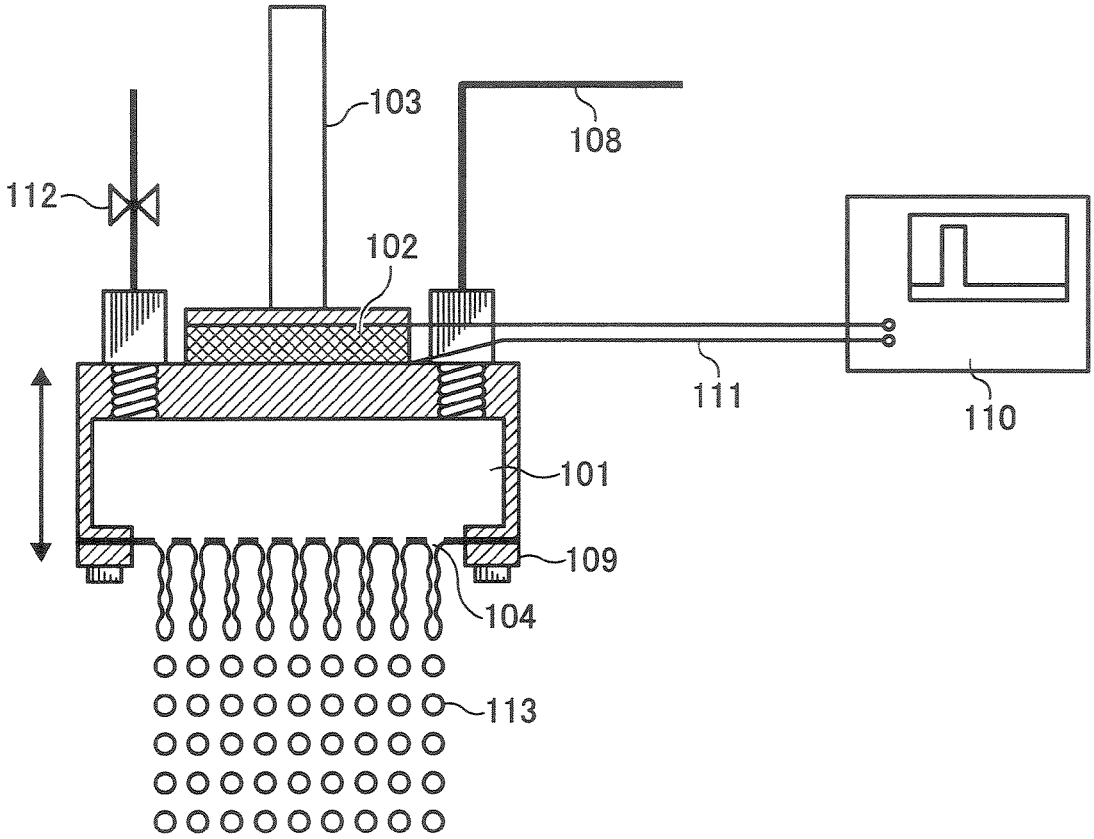
FIG. 3 is a magnified view of the liquid droplet forming means illustrated in FIG. 2.

FIG. 3 is a magnified view of the liquid droplet forming means illustrated in FIG. 2. As illustrated in FIG. 3, the retention part 101 is preferably connected with a pipe 108 configured to feed the toner constituent liquid to the retention part 101, and preferably includes a support mechanism 109 configured to support a plate including the holes 104. The vibration means 102 configured to entirely vibrate the retention part 101 is in contact with the retention part 101. The vibration means 102 is preferably connected to a vibration generating device 110 with a conductive wire 111. It is preferable that an open valve 112 configured to control the inner pressure of the retention part 101 and to remove bubbles present therein is provided so that the stable liquid column is formed.

The vibration means 102 preferably includes a single vibration means and entirely vibrates the retention part 101 including holes 104.

Since the vibration means 102 is in contact with a part of the retention part 101 so as to vibrate the toner constituent liquid, a uniform vibration is applied to the toner constituent liquid, which is to be discharged from the retention part 101 through plural holes 104, and an acoustic wave is generated therein. As a result, more than a hundred liquid-droplet-forming phenomena can be simultaneously performed by the single vibration means.

The vibration means 102 is not particularly limited so long as capable of applying a stable vibration at a specific frequency. For example, the holes 104 are preferably vibrated at a constant frequency due to the expansion and contraction of a piezoelectric substance.

The piezoelectric substance has a function of converting electrical energy into mechanical energy. In particular, the piezoelectric substance expands and contracts upon application of voltage, and thereby the holes 104 are vibrated.

As the piezoelectric substance, for example, a piezoelectric ceramic such as lead zirconate titanate (PZT) can be used. Such a substance is often laminated because of typically having a small displacement. Other specific examples of the piezoelectric substance include, but are not limited to, piezoelectric polymers such as polyvinylidene fluoride (PVDF), and single crystals of quartz, $LiNbO_3$, $LiTaO_3$, $KNbO_3$, etc.

The frequency is preferably from 100 kHz to 10 MHz, and more preferably from 200 kHz to 2 MHz from the viewpoint of producing extremely uniform-sized liquid droplets.

The vibration means 102 is in contact with the retention part 101. The retention part 101 supports the plate including the holes 104. From the viewpoint of uniformly vibrating liquid columns discharged from the holes 104, the vibration means 102 and the plate including the holes 104 are preferably arranged in parallel. These preferably form an angle of not greater than 10° even if the relative position is changed due to the vibration.

Liquid droplets can be formed even if a single hole is arranged. However, from the viewpoint of efficiently producing extremely uniform-sized liquid droplets, it is preferable that plural holes are arranged. The liquid droplets are preferably dried with the solvent removing device 106.

From the viewpoint of improving manufacturability of a toner, it is preferable that plural retention parts, each of which are in contact with an independent vibration part, are provided. The manufacturability of a toner can be represented by the product of the number of liquid droplets generated per unit time (i.e., frequency), the number of vibration means, and the number of holes vibrated by a single vibration means. From the viewpoint of operability, the number of holes vibrated by a single vibration means, i.e., the number of holes arranged on a single retention part is preferably as large as possible. However, if the number is too large, liquid droplets cannot be uniform-sized. In particular, the number of holes vibrated by a single vibration means and arranged on a single retention part is preferably from 10 to 10,000, and more preferably from 10 to 1,000 so as to produce extremely uniform-sized liquid droplets.

The support means 103 configured to support the vibration means 102 is provided so that the retention part 101 and the vibration means 102 are fixed to the device. Rigid bodies such as metals are preferably used for the support means 103, but are not limited thereto. Rubber or polymer materials serving as a vibration absorbing material can be partially provided on the support means 103 if desired, so that the vibration of the retention part 101 is not disturbed by an undesired resonance.

As mentioned above, the holes 104 are configured to discharge a columnar toner constituent liquid. In order to produce extremely uniform-sized liquid droplets at a frequency of not less than 100 kHz without causing hole clogging with a dispersoid not greater than 1 μm, the holes 104 are preferably formed on a metallic plate having a thickness of from 5 to 50 μm and preferably having an opening diameter of from 1 to 40 μm, but the material used and the shape thereof are not particularly limited. As the diameter of the hole increases, the frequency range which can stably produce liquid droplets substantially decreases. Therefore, the frequency is preferably not less than 100 kHz considering manufacturability. The opening diameter represents the diameter when the hole is a perfect circle, and the minor diameter when the hole is an ellipse.

As the liquid supplying means 105, constant rate pumps such as a tube pump, a gear pump, a rotary pump, and a syringe pump are preferably used. In addition, pumps in which a liquid is fed by pressure of compressed air can also be used. The retention part 101 is filled with the toner constituent liquid supplied by the liquid supplying means 105, and then the liquid pressure is increased to the level capable of forming liquid droplets. The liquid pressure can be measured with a pressure gage or a pressure sensor attached to the pump.

A pair of electrodes, configured to charge liquid droplets 113 discharged from the holes 104 can be provided so that the liquid droplets 113 have a monodisperse particle diameter distribution.

The pair of electrodes may be provided facing the holes 104, and preferably have a ring shape, but the shape is not limited thereto.

A method for charging the liquid droplets 113 is not particularly limited. Since the electrodes (hereinafter referred to as ring electrodes) are capable of constantly giving a specific amount of charge to the liquid droplets 113 discharged from the holes 104, a positive or negative charge is preferably given to the liquid droplets 113 by induction charging. In particular, the induction charging is preferably performed by passing the liquid droplets 113 through the ring electrodes to which a direct-current voltage is applied.

The induction charging can also be performed by directly applying a direct-current voltage to the holes 104 so that a potential difference is formed between the bottom of a drying mechanism, which is grounded. In this case, the direct-current voltage is applied via the toner constituent liquid retained in the retention part 101. The induction charging is easily performed when the toner constituent liquid is insulated by being pneumatically supplied to the retention part 101.

It is experimentally proved in methods for producing fine particles, such as an electrospray method and an electrostatic atomization, that liquid droplets riding on an airflow can be highly charged. In this case, the surface area of the liquid droplet reduces as a volatile component vaporizes. Therefore, liquid droplets can be charged much higher compared to solid droplets, in principle. Finally, highly charged solid droplets can be obtained.

A neutralization device configured to neutralize charges of toner particles 115 formed from the liquid droplets 113 may be provided so that the toner particles 115 are contained in a toner container.

A method for neutralizing the toner particles 115 is not particularly limited. For example, methods such as soft X-ray irradiation and plasma irradiation are preferable because the neutralization can be efficiently performed.

The solvent removing device 106 configured to remove a solvent from the liquid droplets 113 is not particularly limited. It is preferable that an airflow is formed by flowing a dried gas 114 (i.e., a gas having a dew point of not greater than −10° C. under atmospheric pressure) in the same direction as the liquid droplets 113 are discharged, so that the liquid droplets 113 are transported by the airflow in the solvent removing device 106 and the solvent is removed from the liquid droplets 113, and then the toner particles 115 are formed.

Specific preferred examples of the dried gas 114 include air and nitrogen gas, but are not limited thereto.

A method for flowing a dried gas 114 into the solvent removing device 106 is not particularly limited. For example, a method in which a dried gas 114 is flowed into the solvent removing device 106 through a supplying tube connected thereto can be used.

The dried gas 114 preferably has as high a temperature as possible, from the viewpoint of improving drying efficiency. In the spray drying, even if the dried gas 114 has a temperature of not less than the boiling point of the solvent, the liquid droplets 113 are not heated to a temperature of not less than the boiling point of the solvent in the constant-drying-rate period. Therefore, the resultant toner particles 115 are not thermally damaged. However, the toner particles 115 tend to be thermally fused with each other when exposed to the dried gas 114 having a temperature of not less than the boiling point of the solvent in the decreasing-drying-rate period (i.e., after the liquid droplets are dried), because the toner particles 115 are mainly composed of a thermoplastic resin. As a result, the particle diameter distribution of the toner particles 115 tends to deteriorate (broadens). In particular, the dried gas 114 preferably has a temperature of from 40 to 200° C., more preferably from 60 to 150° C., and much more preferably from 75 to 85° C.

In order to prevent the liquid droplets 113 from adhering to the inner wall of the solvent removing device 106, it is preferable that an electric field curtain, which is charged to the reverse polarity of the liquid droplets 113, is provided on the inner wall of the solvent removing device 106. Thereby, a transport path configured to pass the liquid droplets 113 is formed surrounded by the electric field curtain.

The toner collection part 107 is provided on the bottom of the toner manufacturing device in view of efficiently collecting and transporting the toner particles 115.

The structure of the toner collection part 107 is not particularly limited. As illustrated in FIG. 2, the toner collection part 107 preferably includes a tapered part in which the opening diameter gradually decreases from the entrance to the exit thereof. The toner particles 115 are preferably transported from the exit of the tapered part to the toner container by riding an airflow of the dried gas 114.

As mentioned above, the toner particles 115 may be fed to the toner container by a pressure of the dried gas 114, or may be sucked from the toner container.

The airflow of the dried gas 114 is preferably a vortex which can generate centrifugal force and truly transport the toner particles 115.

The toner collection part 107 and the toner container are preferably formed by a conductive material and grounded, in view of efficiently transporting the toner particles 115.

The toner manufacturing device is preferably explosion-proof.

The liquid droplets 113 are formed by discharging the toner constituent liquid from the retention part 101 through the holes 104 arranged thereon, while vibrating the retention part 101 at a specific frequency.

The toner constituent liquid is not particularly limited so long as toner constituents are dissolved or dispersed therein. From the viewpoint of imparting a high charge quantity, the toner constituent liquid preferably has an electrolytic conductivity of not less than $1.0\times10^{-7}$ S/m.

From the same viewpoint, a solvent used for the toner constituent liquid also preferably has an electrolytic conductivity of not less than $1.0\times10^{-7}$ S/m.

A method for dissolving or dispersing toner constituents is not particularly limited. For example, a binder resin such as a styrene-acrylic resin, a polyester resin, a polyol resin, and an epoxy resin and a colorant may be melt-kneaded, and then the melt-kneaded mixture is dissolved in an organic solvent in which the binder resin can be dissolved.

In the method for manufacturing a toner according to the first exemplary embodiment of the present invention, the number of liquid droplets discharged from the holes 104 is from as much as several tens of thousands to several millions per second. It is also easy to increase the number of the holes 104. Since the liquid droplets have a very uniform diameter and manufacturability thereof is good, this method is very suitable for manufacturing a toner. In this method, the particle diameter of the resultant toner can be accurately determined by the following equation, irrespective of material used for the toner:

$$Dp=(6QC/\pi f)^{1/3} \quad \text{(I)}$$

wherein Dp represents the particle diameter of a solid particle (i.e., toner), Q represents the flow rate of a liquid (depending on the flow rate of the pump and the diameter of the hole), C represents the volume concentration of solid components, and f represents the vibration frequency.

The particle diameter of the resultant toner can be much more easily determined by the following equation:

$$C=(Dp/Dd)^3 \quad \text{(II)}$$

wherein C (% by volume) represents the volume concentration of solid components, Dp represents the particle diameter of a solid particle (i.e., toner), and Dd represents the particle diameter of a liquid droplet.

The particle diameter of a liquid droplet manufactured by the method according to the first exemplary embodiment of the present invention is twice as large as the opening diameter of the hole, irrespective of the vibration frequency. Therefore, a solid particle having a desired particle diameter can be obtained by preparing a liquid including a specific amount of solid components calculated from the equation (II). For example, when the hole has an opening diameter of 7.5 μm, the liquid droplet has a particle diameter of 15 μm. In this case, a solid particle having a particle diameter of 6.0 μm is obtained when the volume concentration of sold components is 6.40% by volume. The vibration frequency f is preferably as high as possible from the viewpoint of enhancing manufacturability. The flow rate Q of the liquid is determined from the equation (I) depending on the vibration frequency f.

In most conventional toner manufacturing methods, the particle diameter of the resultant toner largely depends on the kind of material used. In the toner manufacturing method of the present invention, particles having a desired particle diameter can be continuously produced by controlling the diameter of the discharged liquid droplet and the concentration of solid components.

Since a toner (i.e., mother toner) manufactured by the toner manufacturing method of the present invention has an extremely narrow particle diameter distribution, the toner has very high fluidity. Therefore, the toner has an advantage that a very small amount of an external additive is needed, in order to decrease the adherence to the toner manufacturing device. In general, the usage of the external additive is preferably as small as possible considering the deterioration of the resultant toner with time and an affect of the external additive (i.e., fine particles) on the human body.

A method for manufacturing a toner according to the second exemplary embodiment of the present invention includes:

dissolving or dispersing toner constituents comprising a resin, a colorant, a release agent, and a graft polymer comprising a polyolefin resin unit and a vinyl resin unit in a solvent, to prepare a toner constituent liquid;

supplying the toner constituent liquid to a retention part configured to retain the toner constituent liquid;

periodically discharging the toner constituent liquid from the retention part through plural holes arranged on a thin film provided on the retention part, while vibrating the thin film by a mechanical vibration means, so that liquid droplets are formed; and converting the liquid droplets into solid toner particles, wherein the mechanical vibration means comprises a circular vibration generating means provided surrounding the holes arranged on the thin film.

A method for manufacturing a toner according to the third exemplary embodiment of the present invention includes:

dissolving or dispersing toner constituents comprising a resin, a colorant, a release agent, and a graft polymer comprising a polyolefin resin unit and a vinyl resin unit in a solvent, to prepare a toner constituent liquid;

supplying the toner constituent liquid to a retention part configured to retain the toner constituent liquid;

periodically discharging the toner constituent liquid from the retention part through plural holes arranged on a thin film provided on the retention part, while vibrating the thin film by a mechanical vibration means, so that liquid droplets are formed; and converting the liquid droplets into solid toner particles, wherein the mechanical vibration means comprises a vibration means comprising a vibrating surface provided parallel to the thin film and vibrates in a vertical direction.

In the present invention, the toner constituent liquid includes a graft polymer including a polyolefin resin unit and a vinyl resin unit together with a release agent. Thereby, the release agent is finely dispersed and prevented from aggregating in the toner constituent liquid. As a result, hole clogging hardly occurs when the toner constituent liquid is periodically discharged by a mechanical vibration means through holes to form liquid droplets, and a toner having a narrow particle diameter distribution can be efficiently prepared.

Comparing with conventional pulverized toners and chemical toners, such a toner has little or no variation in toner properties among individual toner particles. Thereby, a latent image formed on a photoreceptor can be faithfully reproduced for a long period of the time.

Since such a toner prepared by the method of the present invention includes a wax which is finely dispersed by the graft polymer including a polyolefin resin unit and a vinyl resin unit, the toner has good hot offset resistance without causing migration of the release agent to the surface of the toner or filming problem in that the release agent forms a film thereof on a photoreceptor, etc. In addition, the toner also has a small particle diameter and a narrow particle diameter distribution, and therefore high quality images can be stably produced.

Further, it is preferable that the mechanical vibration means vibrates at a frequency of not less than 20 kHz and less than 2.0 MHz, the polyolefin resin has a softening point of from 70 to 150° C., the vinyl resin has an SP value of from 10.0 to 11.5, and the toner includes the graft polymer in an amount of from 10 to 150 parts by weight based on 100 parts by weight of the release agent.

In order to form liquid droplets of the toner constituent liquid in a gas phase, methods using a single-fluid nozzle (pressurization nozzle) which sprays a liquid by pressurizing the liquid, a multi-fluid nozzle which sprays a liquid by mixing the liquid with a compressed gas, and a rotating-disk spraying device which forms liquid droplets using centrifugal force of the rotating disk can be used. In order to obtain a toner having a small particle diameter, the multi-fluid nozzle and the rotating-disk spraying device are preferably used. As the multi-fluid nozzle, an external mixing double-fluid nozzle is typically used. In order to obtain a toner having a much smaller and uniform particle diameter, various advanced nozzles such as an internal mixing double-fluid nozzle and a quadruple-fluid nozzle have been developed. For the same purpose, the disk of the rotating-disk spraying device is improved to have a dish, bowl, or multiblade shape.

However, toners obtained by the above methods may have a wide particle diameter distribution which needs to be classified.

The present inventors found out a method for manufacturing a toner having a narrow particle diameter distribution, in which a toner constituent liquid is periodically discharged through plural holes having a uniform particle diameter by a mechanical vibration means so as to form liquid droplets.

As mentioned above, liquid droplets of a toner constituent liquid are formed by mechanically vibrating a thin film including plural holes so as to discharge the toner constituent liquid. The mechanical vibration means is not particularly limited so long as capable of vibrating in a direction vertical to the thin film including the plural holes. In the present invention, the following two types of mechanical vibration means can be used.

The one is a mechanical vibration means including a vibrating surface provided parallel to the thin film and vibrating in a vertical direction. This type will be hereinafter referred to as "a horn vibration means".

The other one is a mechanical vibration means including a circular vibration generating means provided surrounding the holes arranged on the thin film. This type will be hereinafter referred to as "a ring vibration means".

Figure 4:
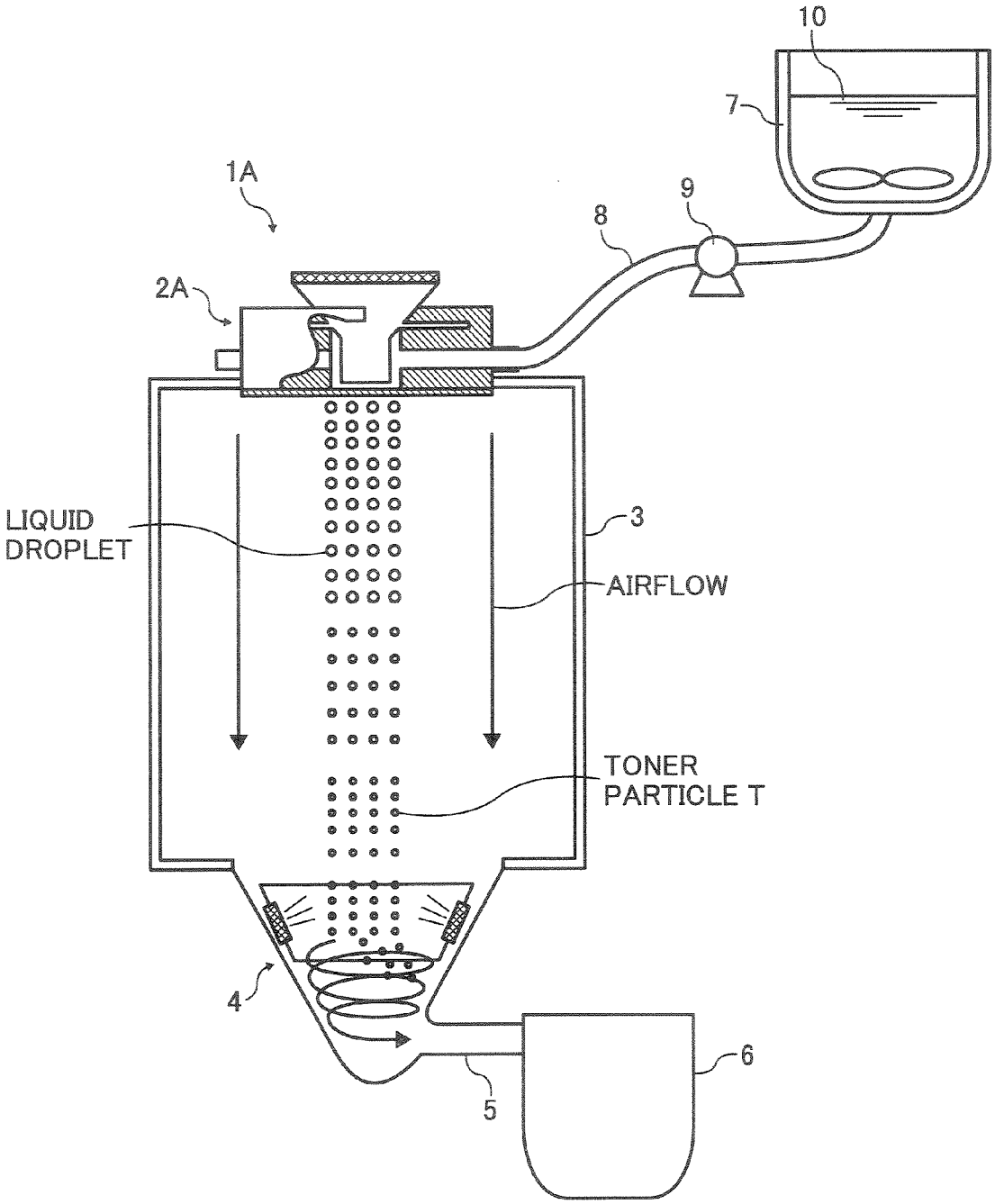
FIG. 4 is a schematic view illustrating a second exemplary embodiment of the toner manufacturing device, including a horn vibration means, for use in the present invention.

FIG. 4 is a schematic view illustrating a second exemplary embodiment of the toner manufacturing device, including a horn vibration means, for use in the present invention.

A toner manufacturing device 1A includes a liquid droplet injection unit 2A, including a horn vibration means, serving as a liquid droplet forming means configured to discharge a toner constituent liquid 10 comprising a resin and a colorant to form liquid droplets thereof; a toner particle formation part 3 serving as a toner particle forming means configured to form toner particles T by solidifying the liquid droplets of the toner constituent liquid 10 discharged from the liquid droplet injection unit 2A; a toner collection part 4 configured to collect the toner particles T formed in the toner particle formation part 3; a toner retention part 6 configured to retain the toner particles T transported from the toner collection part 4 through a tube 5; a raw material container 7 configured to contain the toner constituent liquid 10; a pipe 8 configured to pass the toner constituent liquid 10 from the raw material container 7 to the liquid droplet injection unit 2A; and a pump 9 configured to supply the toner constituent liquid 10 by pressure when the apparatus is in operation.

The toner constituent liquid 10 is self-supplied from the raw material container 7 when the liquid droplet injection unit 2A discharges liquid droplets. When the apparatus is in operation, the toner constituent liquid 10 is supplementarily supplied by the pump 9. The toner constituent liquid 10 is a solution or dispersion in which toner constituents comprising a binder resin and a colorant are dissolved or dispersed in a solvent.

Next, the liquid droplet injection unit 2A will be explained in detail.

Figure 5:
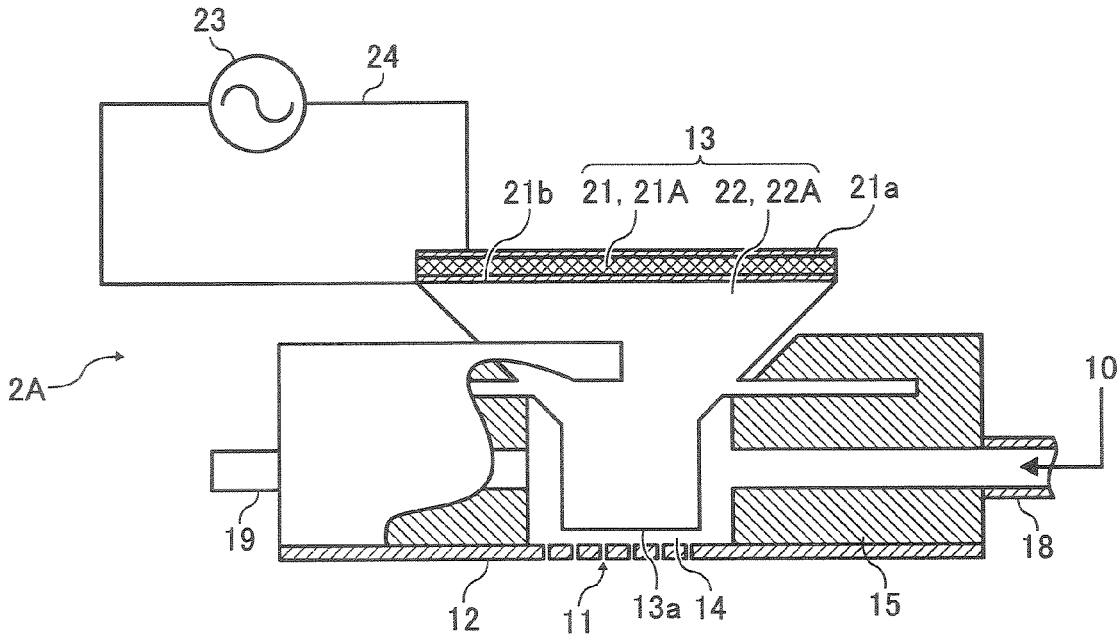
FIG. 5 is a schematic cross-sectional view illustrating an embodiment of the liquid droplet injection unit of the toner manufacturing device illustrated in FIG. 4.
Figure 6:
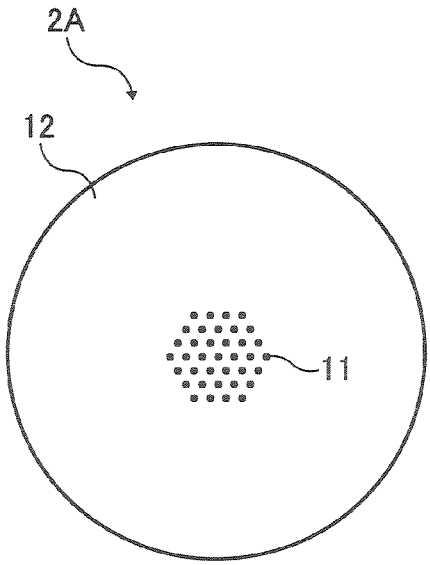
FIG. 6 is a schematic bottom view illustrating an embodiment of the liquid droplet injection unit of the toner manufacturing device illustrated in FIG. 4.
Figure 7:
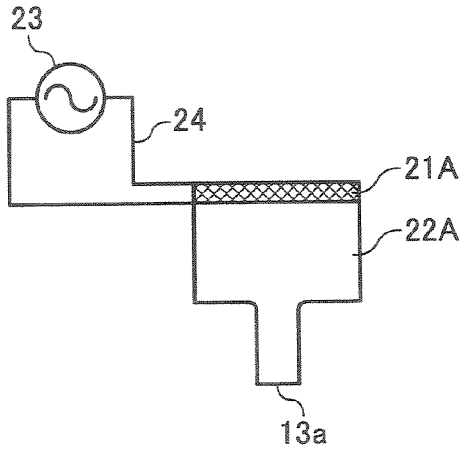
FIGS. 7 to 9 are schematic views illustrating embodiments of horn vibrators for use in the present invention.
Figure 8:
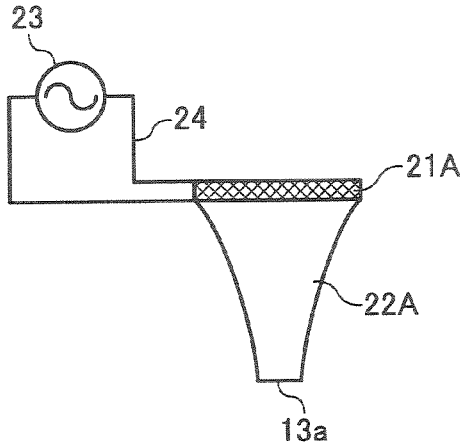
Figure 9:
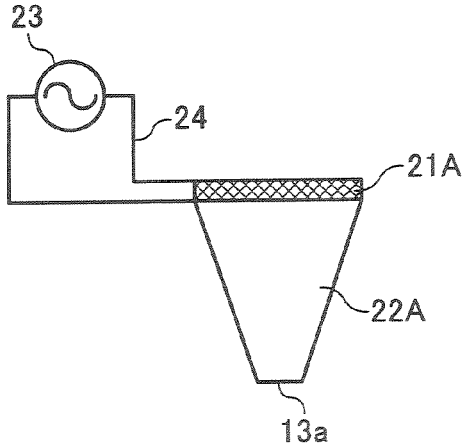

FIG. 5 is a schematic cross-sectional view illustrating an embodiment of the liquid droplet injection unit 2A. FIG. 6 is a schematic bottom view illustrating an embodiment of the liquid droplet injection unit 2A.

The liquid droplet injection unit 2A includes a thin film 12 including plural holes 11, a mechanical vibration means (hereinafter vibration means) 13 configured to vibrate the thin film 12, and a flow path member 15 configured to form a liquid flow path (i.e., retention part) 14 configured to supply the toner constituent liquid 10 to a space formed between the thin film 12 and the vibration means 13.

The thin film 12 including the plural holes 11 are provided parallel to a vibrating surface 13*a* of the vibration means 13. A part of the thin film 12 is fixed to the flow path member 15 with a solder or a binder resin material which does not dissolve in the toner constituent liquid 10. In particular, the thin film 12 is provided vertical to the vibration direction of the vibration means 13. A communication means 24 is provided so that an electrical signal from a driving signal generating source 23 is transmitted to the upper and the lower surfaces of a vibration generating means 21 of the vibration means 13 and is converted into a mechanical vibration. As the communication means 24 for transmitting an electrical signal, a lead wire of which the surface is insulation-coated is preferably used. As the vibration means 13, vibrators having a large vibration amplitude such as a horn vibrator and a bolted Langevin vibrator are preferably used in order to effectively and stably manufacture a toner.

The vibration means 13 includes the vibration generating means 21 configured to generate a vibration and a vibration amplifying means 22 configured to amplify the vibration generated by the vibration generating means 21. When a driving voltage (driving signal) having a specific frequency is applied from the driving signal generating source 23 to electrodes 21*a* and 21*b* of the vibration generating means 21, a vibration is generated by the vibration generating means 21 and amplified by the vibration amplifying means 22. As a result, the vibrating surface 13*a*, provided parallel to the thin film 12, periodically vibrates. And then the thin film 12 vibrates at a specific frequency due to the periodical pressure applied from the vibrating surface 13*a*.

The vibration means 13 is not particularly limited so long as capable of certainly applying a longitudinal vibration to the thin film 12 at a constant frequency. As the vibration generating means 21, a piezoelectric substance 21A in which a bimorph flexural vibration is excited is preferably used. The piezoelectric substance 21A has a function of converting electrical energy into mechanical energy. In particular, a flexural vibration is excited when a voltage is applied, resulting in vibrating the thin film 12.

As the piezoelectric substance 21A, for example, a piezoelectric ceramic such as lead zirconate titanate (PZT) can be used. Such a substance is often laminated because of typically having a small displacement. Other specific examples of the piezoelectric substance include, but are not limited to, piezoelectric polymers such as polyvinylidene fluoride (PVDF), and single crystals of quartz, $LiNbO_3$, $LiTaO_3$, $KNbO_3$, etc.

The arrangement of the vibration means 13 is not particularly limited so long as the vibration means 13 vibrates in a direction vertical to the thin film 12 including the plural holes 11. However, the vibrating surface 13*a* is arranged in parallel with the thin film 12.

The vibration means 13 illustrated in FIG. 5 is a horn vibrator. In the horn vibrator, the amplitude of the vibration generating means 21 (such as a piezoelectric substance 21A) can be amplified by the vibration amplifying means 22 (such as a horn 22A). Therefore, the vibration generating means 21 may vibrate just at a small amplitude, resulting in lengthening the life of the apparatus because the mechanical load applied can be reduced.

As the horn vibrator, any known horn vibrators can be used. For example, a step-type horn vibrator illustrated in FIG. 7, an exponential-type horn vibrator illustrated in FIG. 8, and a conical-type horn vibrator illustrated in FIG. 9 can be used. (The same reference numbers illustrated in FIGS. 5 to 9 represent the same components.) The horn vibrator is designed based on the following concept: the piezoelectric substance 21A is provided on a surface of the horn 22A being large in area so that the horn 22A is efficiently excited to vibrate by the longitudinal vibration of the piezoelectric substance 21A, and the vibrating surface 13*a* is provided on another surface of the horn 22A being small in area so that the vibration surface 13*a* vibrates at the maximum amplitude. Lead wires (i.e., communication means) 24 are provided on each of the upper and lower surfaces of the piezoelectric substance 21A so as to transmit an alternate voltage signal from the driving signal generating source 23. The shape of the horn vibrator is designed so that the vibrating surface 13*a* becomes the maximum vibrating surface in the horn vibrator.

As the vibration means 13, a bolted Langevin vibrator having high strength can also be used. A piezoelectric ceramic is mechanically connected to the bolted Langevin vibrator, and therefore the vibrator is hardly damaged even if excited by a large amplitude.

As illustrated in FIG. 5, at least one liquid supplying tube 18 is provided on the retention part 14. The liquid supplying tube 18 is configured to supply the toner constituent liquid 10 to the retention part 14 through the liquid flow path 14. A bubble discharging tube 19 may be optionally provided, if desired. The liquid droplet injection unit 2A is fixed on the top surface of the toner particle formation part 3 by a support member (not shown) attached to the flow path member 15. Of course, the liquid droplet injection unit 2A may be fixed on the side surface or the bottom surface of the toner particle collection part 3.

In general, the smaller the frequency of the generated vibration, the larger the size of the vibration means 13. The vibration means 13 may be directly drilled so that a retention part is provided according to the required frequency. It is also possible to efficiently and entirely vibrate the retention part. In this case, a surface to which a thin film including plural holes is attached is defined as a vibrating surface.

Figure 10:
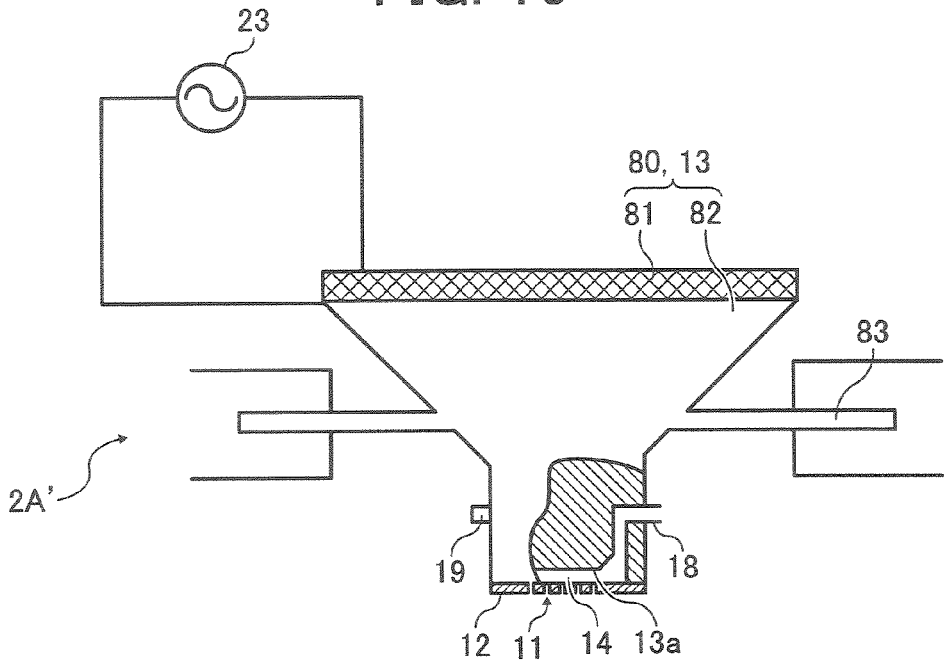
FIGS. 10 and 11 are schematic cross-sectional views illustrating another embodiments of the liquid droplet injection unit of the toner manufacturing device illustrated in FIG. 4.
Figure 11:
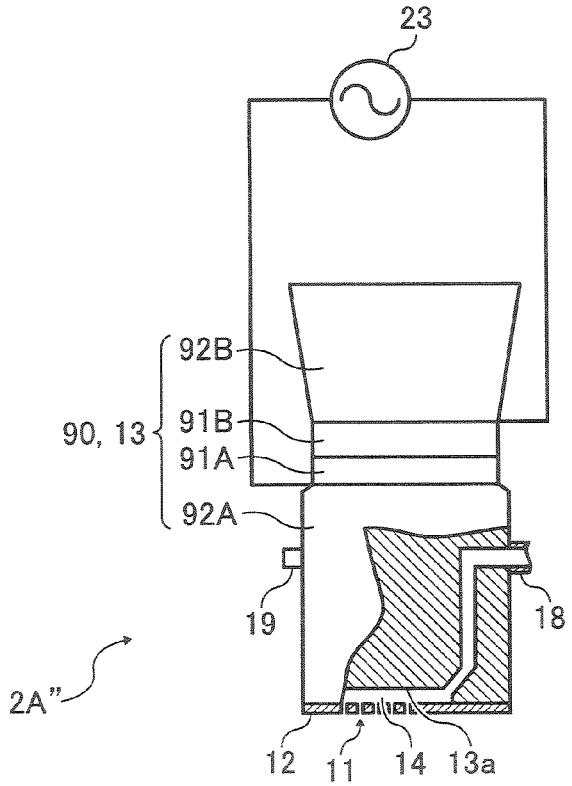

FIGS. 10 and 11 are schematic views illustrating additional embodiments of the liquid droplet injection unit 2A. (The same reference numbers illustrated in FIGS. 5 to 11 represent the same components.)

A liquid droplet injection unit 2A' illustrated in FIG. 10 includes a horn vibrator 80 (i.e., vibration means 13) including a piezoelectric substance 81 serving as a vibration generating part and a horn 82 serving as a vibration amplifying part. A retention part 14 is formed in a part of the horn 82. The liquid droplet injection unit 2A' is preferably fixed on the side surface of the toner particle formation part 3 by a flange 83 integrated with the horn 82. In view of reducing vibration loss, the liquid droplet injection unit 2A' may be fixed by an elastic body (not shown).

A liquid droplet injection unit 2A" illustrated in FIG. 11 includes a bolted Langevin vibrator 90 (i.e., vibration means 13) in which piezoelectric substances 91A and 91B serving as vibration generating parts and horns 92A and 92B are mechanically tightly-fixed together. A retention part 14 is formed in a part of the horn 92A. The vibrator may be larger in size depending on the frequency. As illustrated in FIG. 11, the vibrator may be modified to include a liquid flow path and a retention part therein, and a metallic thin film 12 including plural holes 11 may be attached to the vibrator 90.

Although only one liquid droplet injection unit 2A is fixed to the toner particle formation part 3 in the toner manufacturing device 1A illustrated in FIG. 4, a plurality of liquid droplet injection units 2A are preferably arranged on the top surface of the toner particle formation part 3, in view of improving manufacturability. The number of the liquid droplet injection units 2A is preferably 100 to 1,000, from the viewpoint of controllability. In this case, the toner constituent liquid 10 is supplied to each of the retention parts 14 of the one liquid droplet injection units 2A from the raw material container 7 through the pipe 8. The toner constituent liquid 10 may be self-supplied from the raw material container 7 when the liquid droplet injection unit 2A discharges liquid droplets. Alternatively, the toner constituent liquid 10 may be supplementarily supplied by the pump 9 when the apparatus is in operation.

Figure 12:
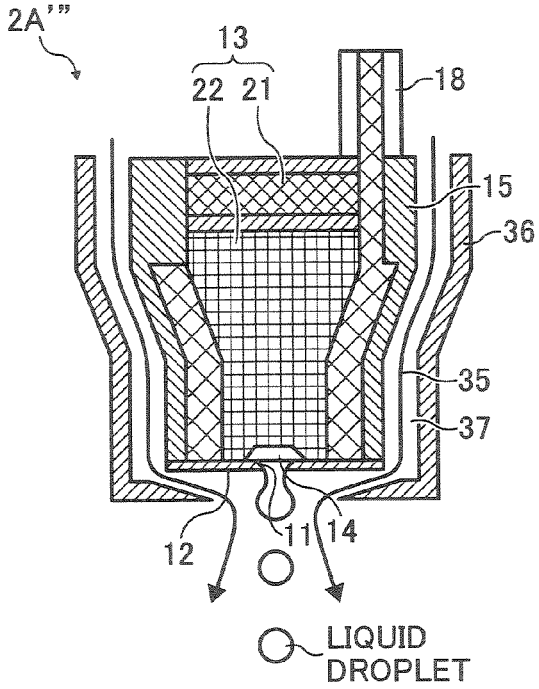
FIG. 12 is a schematic cross-sectional view illustrating yet another embodiment of the liquid droplet injection unit of the toner manufacturing device illustrated in FIG. 4.

FIG. 12 is a schematic cross-sectional view illustrating another embodiment of the liquid droplet injection unit 2A. (The same reference numbers illustrated in FIGS. 5 to 12 represent the same components.)

A liquid droplet injection unit 2A'" includes a horn vibrator as a vibration means 13. A flow path member 15 configured to supply the toner constituent liquid 10 is provided surrounding the vibration means 13, and a retention part 14 is provided in a part of a horn 22 where facing a thin film 12. Further, an airflow path formation member 36 is provided surrounding the flow path member 15 while leaving a space therebetween so that an airflow path 37 configured to pass an airflow 35 is formed. For the purpose of simplifying FIG. 12, only one hole 11 is illustrated, but the thin film 12 actually includes plural holes 11.

Figure 13:
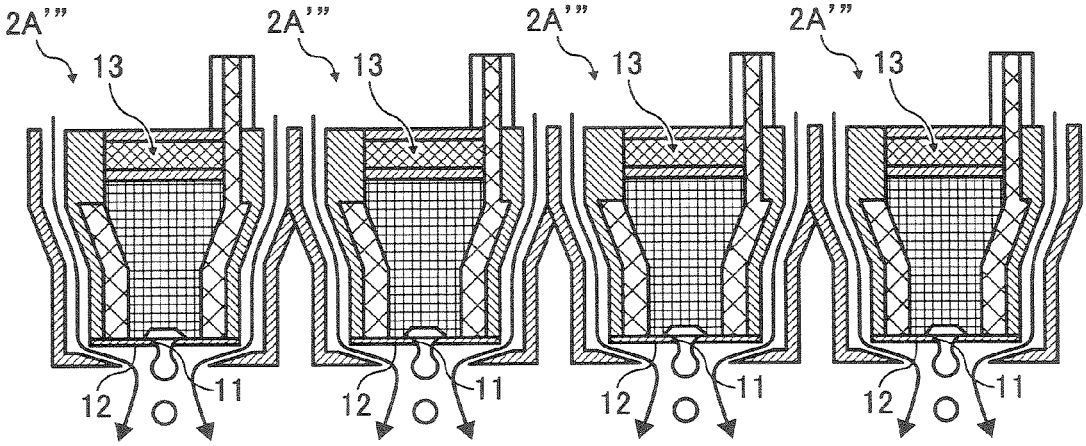
FIG. 13 is a schematic cross-sectional view illustrating an embodiment of a plurality of the liquid droplet injection unit illustrated in FIG. 12.

As illustrated in FIG. 13, a plurality of the liquid droplet injection units 2A'" may be arranged on the top surface of the toner particle formation part 3. The number of the liquid droplet injection units 2A'" is preferably 100 to 1,000, in view of improving manufacturability.

Figure 14:
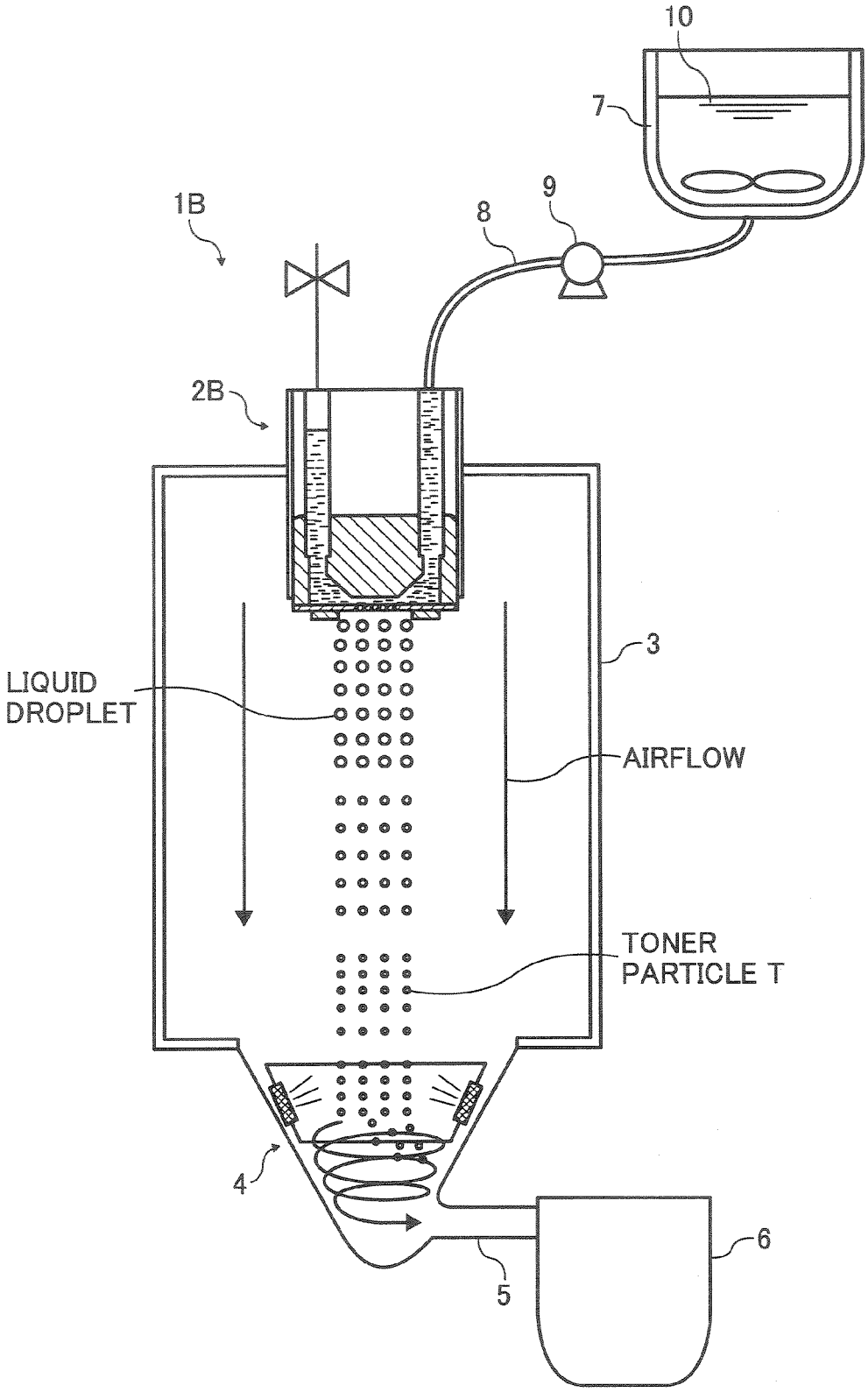
FIG. 14 is a schematic view illustrating a third exemplary embodiment of the toner manufacturing device, including a ring vibration means, for use in the present invention.

FIG. 14 is a schematic view illustrating a third exemplary embodiment of the toner manufacturing device, including a ring vibration means, for use in the present invention. (The same reference numbers illustrated in FIGS. 5 and 14 represent the same components.) A toner manufacturing device 1B includes a liquid droplet injection unit 2B including a ring vibration means.

Figure 15:
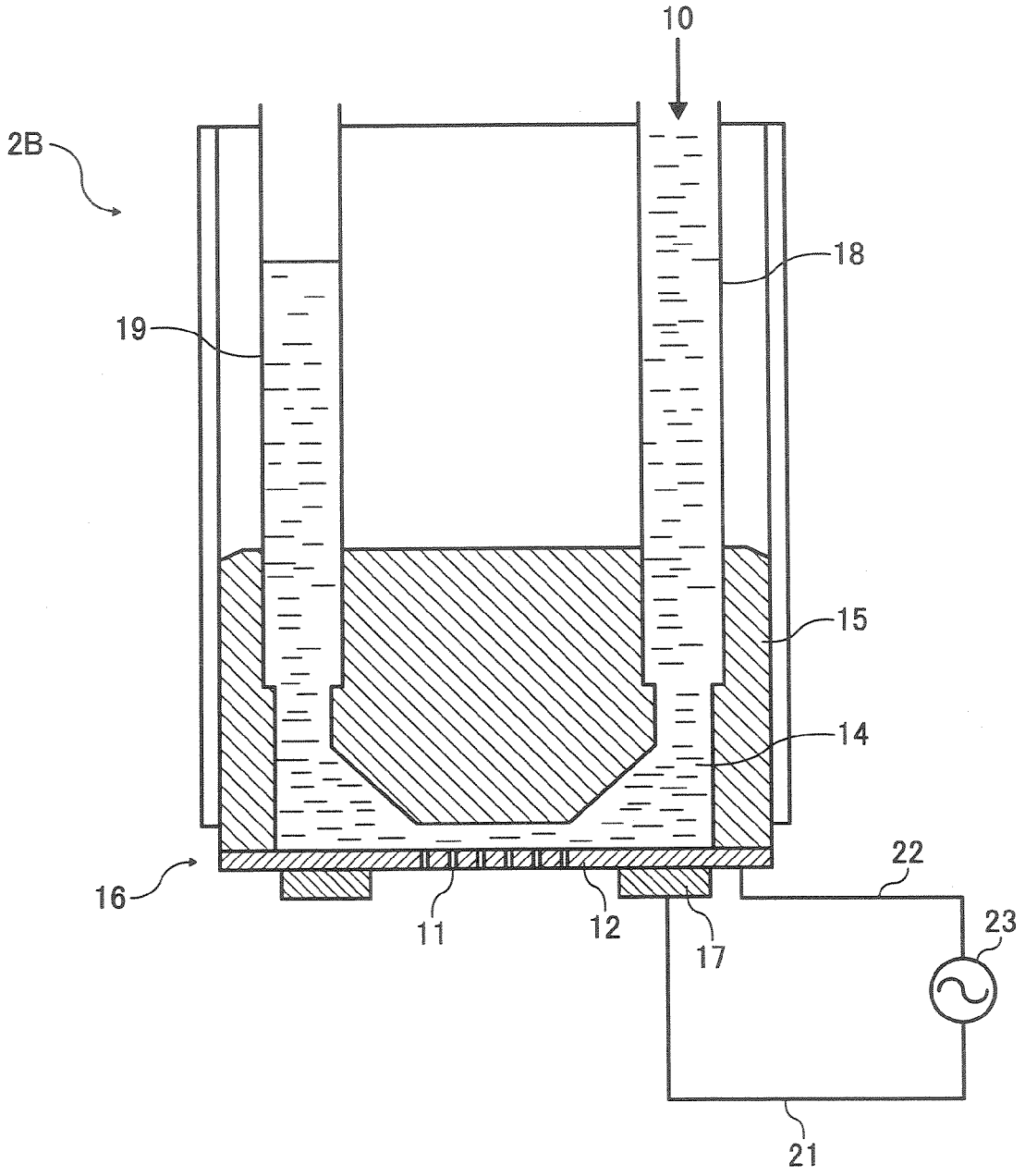
FIG. 15 is a schematic cross-sectional view illustrating an embodiment of the liquid droplet injection unit of the toner manufacturing device illustrated in FIG. 14.
Figure 16:
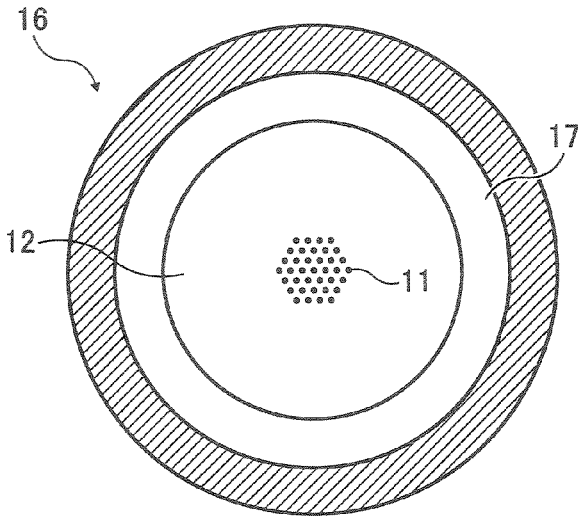
FIG. 16 is a schematic bottom view illustrating an embodiment of the liquid droplet injection unit of the toner manufacturing device illustrated in FIG. 14.

FIG. 15 is a schematic cross-sectional view illustrating an embodiment of the liquid droplet injection unit 2B. FIG. 16 is a schematic bottom view illustrating an embodiment of the liquid droplet injection unit 2B.

The liquid droplet injection unit 2B includes a liquid droplet forming means 16 configured to discharge a toner constituent liquid 10 comprising a resin and a colorant to form liquid droplets thereof, and a flow path member 15 configured to form a liquid flow path (i.e., retention part) 14 configured to supply the toner constituent liquid 10 to the liquid droplet forming means 16.

Figure 17:
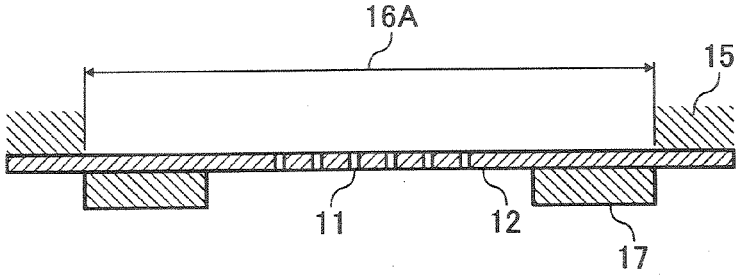
FIG. 17 is a schematic cross-sectional view illustrating an embodiment of the liquid droplet forming means of the liquid droplet injection unit illustrated in FIG. 15.

FIG. 17 is a schematic cross-sectional view illustrating an embodiment of the liquid droplet forming means 16.

The liquid droplet forming means 16 includes a thin film 12 including plural holes 11, and a ring-shaped vibration generating means 17 configured to vibrate the thin film 12. The outermost portion of the thin film 12 is fixed to the flow path member 15 with a solder or a binder resin material which does not dissolve in the toner constituent liquid 10. The ring-shaped vibration generating means 17 is provided surrounding a transformable region (i.e., a region not fixed to the flow path member 15) 16A of the thin film 12. The vibration generating means 17 generates a flexural vibration when a driving voltage (driving signal) having a specific frequency is applied from a driving signal generating source 23 through lead wires 21 and 22 (illustrated in FIG. 15).

Figure 18:
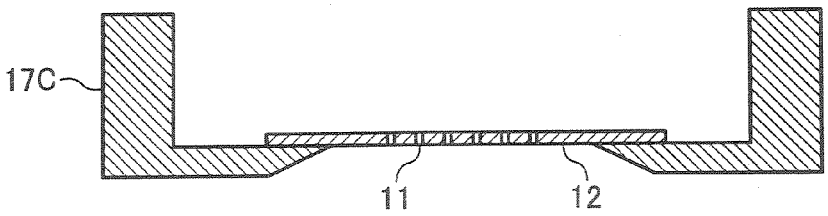
FIG. 18 is a schematic cross-sectional view illustrating a comparative embodiment of the liquid droplet forming means.

Since the vibration generating means 17 is provided surrounding the transformable region 16A of the thin film 12 including the plural holes 11, the amount of the displacement of the thin film 12 is relatively large compared to that of a comparative embodiment illustrated in FIG. 18 in which a comparative vibration generating means 17C supports the thin film 12. Therefore, the plural holes 11 can be arranged on a relatively large area (having a diameter $\phi$ of not less than 1 mm). As a result, a large amount of liquid droplets can be simultaneously and stably discharged from the plural holes 11.

Figure 19:
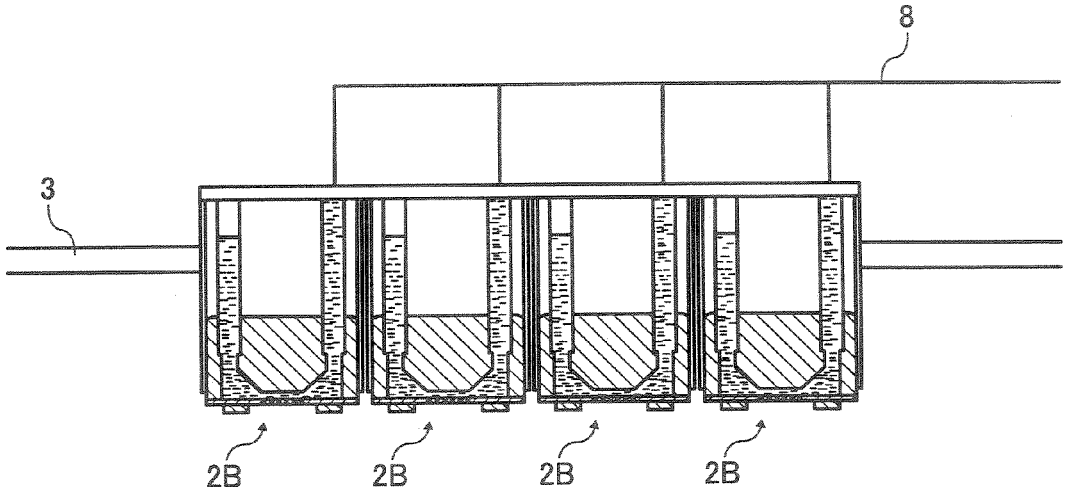
FIG. 19 is a schematic cross-sectional view illustrating an embodiment of a plurality of the liquid droplet injection unit illustrated in FIG. 15.

Although only one liquid droplet injection unit 2B is fixed to the toner particle formation part 3 in the toner manufacturing device 1B illustrated in FIG. 14, a plurality of liquid droplet injection units 2B are preferably arranged on the top surface of the toner particle formation part 3 as illustrated in FIG. 19. The number of the liquid droplet injection units 2B is preferably 100 to 1,000, from the viewpoint of controllability. In this case, the toner constituent liquid 10 is supplied to each of the liquid droplet injection units 2B from the raw material container 7 through the pipe 8. Thereby, much larger amount of liquid droplets can be simultaneously discharged, resulting in improving manufacturability.

Next, the mechanism for forming liquid droplets with the liquid droplet injection unit 2B will be explained.

In the liquid droplet injection unit 2B, a vibration generated by the vibration means (i.e., mechanical vibration means) 13 is propagated to the thin film 12 including the plural holes 11 facing the retention part 14 so that the thin film 12 periodically vibrates. The plural holes 11 are arranged on a relatively large area (having a diameter ϕ of not less than 1 mm) so that liquid droplets can be stably discharged therefrom.

Figure 20A:
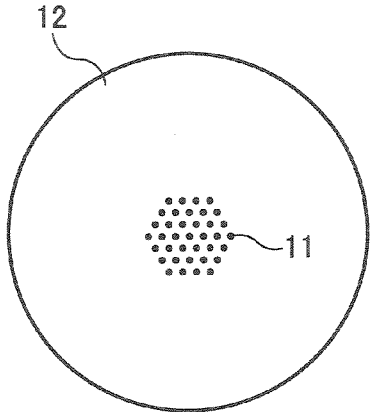
FIGS. 20A and 20B are schematic bottom and cross-sectional views, respectively, illustrating an embodiment of the thin film used for the liquid droplet injection unit illustrated in FIG. 15.
Figure 20B:
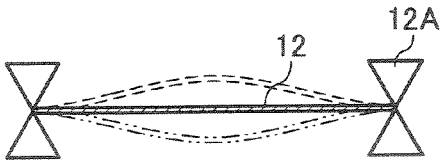

FIGS. 20A and 20B are schematic bottom and cross-sectional views, respectively, illustrating an embodiment of the thin film 12.

Figure 21:
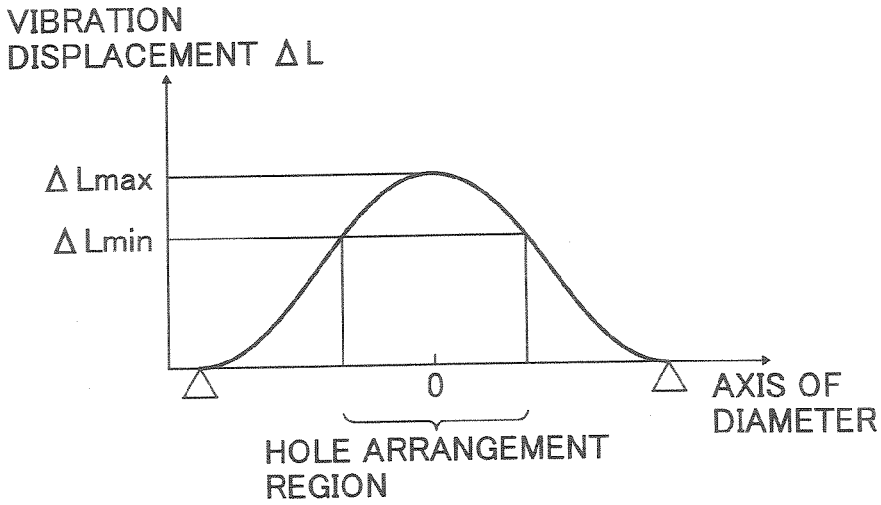
FIG. 21 is a cross-sectional view of the thin film illustrated in FIG. 20 for explaining how the thin film vibrates in the fundamental vibration mode.

When the peripheral portion 12A of the thin film 12, which is a simple circular film, is fixed, the thin film 12 basically vibrates as shown in FIG. 21. FIG. 21 is a cross-sectional view of the thin film 12 for explaining how the thin film 12 vibrates in the fundamental vibration mode. Namely, the thin film 12 periodically vibrates in a vertical direction while the center point O displaces at the maximum displacement ΔLmax and the peripheral portion forms a node.

Figure 22:
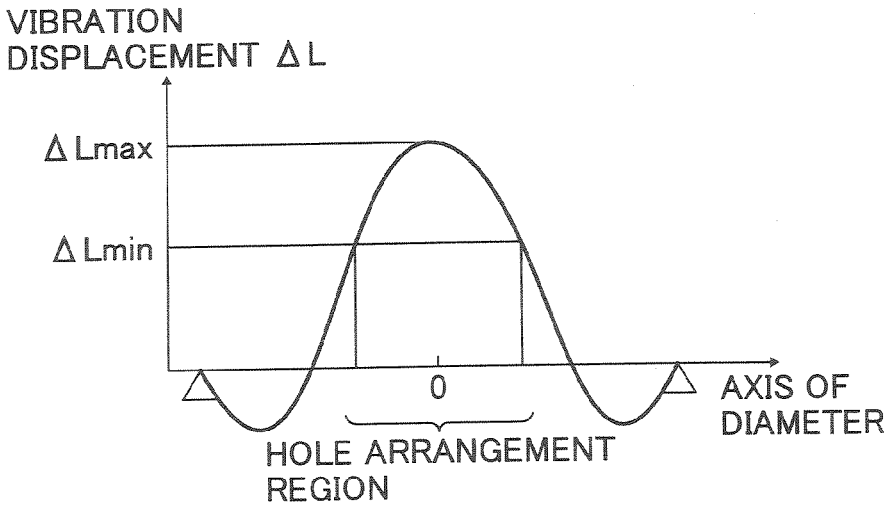
FIGS. 22 and 23 are cross-sectional views of the thin film illustrated in FIG. 20 for explaining how the thin film vibrates in the secondary and tertiary vibration modes, respectively.
Figure 23:
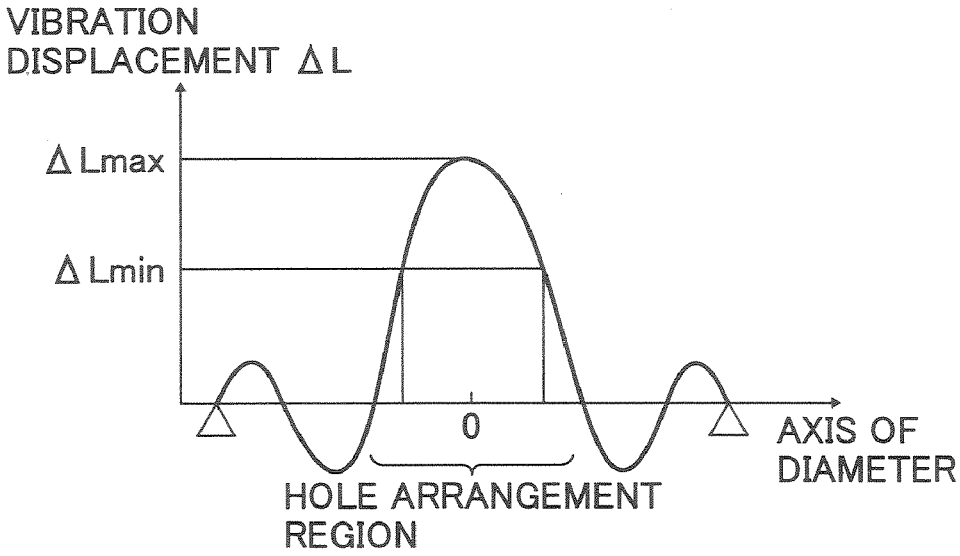
Figure 24:
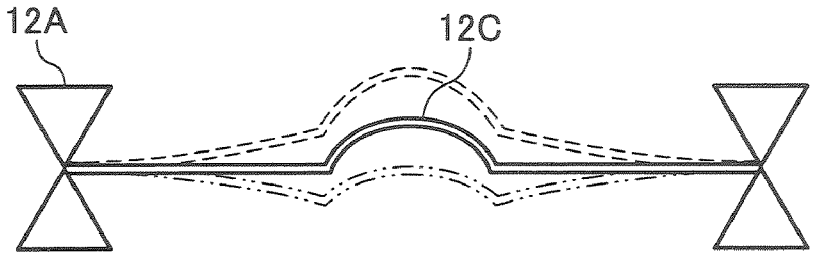
FIG. 24 is a schematic cross-sectional view illustrating another embodiment of the thin film used for the liquid droplet injection unit illustrated in FIG. 15.

It is known that the thin film 12 may vibrate with the secondary or tertiary vibration modes illustrated in FIGS. 22 and 23, respectively. In these cases, one or more nodes are concentrically formed in the circular film 12, and the film 12 axisymmetrically transforms. When the thin film is a thin film 12C having a convexity in the center portion as illustrated in FIG. 24, the movement direction of liquid droplets and the amplitude can be controlled.

When the circular thin film 12 vibrates, a sound pressure $P_{ac}$ generates in the toner constituent liquid 10 present in the vicinity of the holes 11. The sound pressure $P_{ac}$ is proportional to the vibration rate $V_m$ of the thin film 12. It is known that the sound pressure $P_{ac}$ generates as a counter reaction of the radiation impedance of $Z_r$ of the medium (i.e., toner constituent liquid). The sound pressure $P_{ac}$ is represented by the following equation:

$$P_{ac}(r,t)=Z_r \cdot V_m(r,t)$$

The vibration rate $V_m$ of the thin film 12 is a function of time because of periodically varying with time. Periodic variations such as a sine wave and a square wave can be formed. The vibration rate $V_m$ is also a function of position because the vibration displacement varies by location. As mentioned above, the thin film 12 axisymmetrically vibrates. Therefore, the vibration rate $V_m$ is substantially a function of coordinates of the radius.

Namely, when a sound pressure $P_{ac}$ proportional to the vibration rate $V_m$ of the thin film 12 generates, the toner constituent liquid 10 is discharged to a gas phase due to the periodic variation of the sound pressure $P_{ac}$.

The toner constituent liquid 10 periodically discharged to a gas phase forms spherical particles due to the difference in surface tension between the liquid phase and the gas phase. Thus, liquid droplets are periodically formed.

The vibration frequency of the thin film 12 capable of forming droplets is typically from 20 kHz to 2.0 MHz, and preferably from 50 kHz to 500 kHz. When the frequency is not less than 20 kHz, the colorant and wax particles are well dispersed in the toner constituent liquid 10 due to the excitation of the liquid.

Further, when the displacement amount of the sound pressure is not less than 10 kPa, the colorant and wax particles are much well dispersed in the toner constituent liquid 10.

The larger the vibration displacement near a hole of the thin film, the larger the diameter of liquid droplets discharged therefrom. When the vibration displacement is too small, small liquid droplets are formed or no liquid droplet is formed. In order to reduce variations in size of liquid droplet by location of the hole, the holes are preferably arranged on appropriate positions.

In the present invention, the holes are preferably arranged on a region where the ratio (ΔLmax/ΔLmin) of the maximum vibration displacement ΔLmax to the minimum vibration displacement ΔLmin is not greater than 2.0, as illustrated in FIGS. 21 to 23. In this case, variations in size of liquid droplets can be reduced so that the resultant toner can provide high quality images.

When the toner constituent liquid has a viscosity of not greater than 20 mPa·s and a surface tension of from 20 to 75 mN/m, undesired small liquid droplets are produced in the same region. Therefore, the displacement amount of the sound pressure needs to be not greater than 500 kPa, and more preferably not greater than 100 kPa.

As mentioned above, the thin film 12 including plural holes 11 is configured to discharge the toner constituent liquid so as to form liquid droplets thereof.

Materials used for the thin film 12 and the shape of the holes 11 are not particularly limited. However, the thin film 12 is preferably formed from a metal plate having a thickness of from 5 to 500 μm and each of the holes 11 preferably has an opening diameter of from 3 to 35 μm, from the viewpoint of forming extremely uniform-sized liquid droplets when the toner constituent liquid is discharged therefrom. The opening diameter represents the diameter when the hole is a perfect circle, and the minor diameter when the hole is an ellipse. The number of the holes 11 is preferably from 2 to 3,000.

A drying process, in which the solvent in the liquid droplets is removed, is performed by releasing the liquid droplets into a gas such as heated dried nitrogen. A secondary drying process such as fluidized bed drying and vacuum drying may be optionally performed, if desired.

(Toner)

The toner of the present invention is manufactured by the toner manufacturing method of the present invention mentioned above.

The toner of the present invention has a nearly monodisperse particle diameter distribution. The toner preferably has a particle diameter distribution (i.e., the ratio of the weight average particle diameter to the number average particle diameter) of from 1.00 to 1.15, and more preferably from 1.00 to 1.05, and a weight average particle diameter of from 1 to 20 μm, and more preferably from 1 to 15 μm.

The toner prepared by the toner manufacturing method of the present invention can be easily re-dispersed, (i.e., suspended) in an airflow due to electrostatic repulsion effects. Therefore, the toner can be transported to the developing region without using a transport means used in conventional electrophotography. In other words, the toner can be satisfactorily transported even if the airflow is weak. The toner can be transported to the developing region by a simple air pump to develop an electrostatic latent image. The electrostatic latent image is faithfully developed with the toner by the so-called powder cloud development, in which the image formation is not disturbed by the airflow.

The toner of the present invention can also be used for conventional developing methods. In this case, image forming members such as a carrier and a developing sleeve do not need to have a function of friction-charging, while having a function of transporting a toner. Therefore, various kinds of materials can be used for the image forming members, resulting in improvement of durability and reduction of manufacturing cost.

The toner of the present invention includes a release agent, a graft polymer including a polyolefin resin unit and a vinyl resin unit, and other constituents used for conventional toners. For example, the toner of the present invention can be prepared as follows:

dissolving a binder resin such as a styrene-acrylic resin, a polyester resin, a polyol resin, and an epoxy resin, in an organic solvent;

dispersing a colorant therein;

dispersing or dissolving a release agent and a graft polymer including a polyolefin resin unit and a vinyl resin unit therein, to prepare a toner constituent liquid;

forming liquid droplets of the toner constituent liquid by the method mentioned above; and drying the liquid droplets to form solid particles.

The toner constituent liquid can also be prepared by melt-kneading toner constituents, and then dissolving or dispersing the melt-kneaded mixture in an organic solvent.

A toner including a release agent and a graft polymer including a polyolefin resin unit and a vinyl resin unit has not only good hot offset resistance but also nozzle clogging resistance because the release agent can be finely dispersed in the toner without causing aggregation.

The toner of the present invention includes a resin, a colorant, a release agent, and a graft polymer including a polyolefin resin unit and a vinyl resin unit, and optionally includes a charge controlling agent, a magnetic material, a fluidity improving agent, a lubricant, a cleaning auxiliary agent, a resistance controlling agent, etc., if desired.

(Resin)

As the resin, a binder resin can be used.

Specific examples of the binder resins include, but are not limited to, vinyl homopolymers and copolymers of vinyl monomers (such as a styrene monomer, an acrylic monomer, and a methacrylic monomer), polyester resins, polyol resins, phenol resins, silicone resins, polyurethane resins, polyamide resins, furan resins, epoxy resins, xylene resins, terpene resins, coumarone-indene resins, polycarbonate resins, and petroleum resins.

Specific examples of the styrene monomers include, but are not limited to, styrenes such as styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; and derivatives thereof.

Specific examples of the acrylic monomers include, but are not limited to, acrylic acids and esters thereof (i.e., acrylates) such as methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate.

Specific examples of the methacrylic monomers include, but are not limited to, methacrylic acids and esters thereof (i.e., methacrylates) such as methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, and diethylaminoethyl methacrylate.

Specific examples of other vinyl monomers include, but are not limited to, the following compounds:

(1) monoolefins such as ethylene, propylene, butylene, and isobutylene;
(2) polyenes such as butadiene and isoprene;
(3) halogenated vinyl compounds such as vinyl chloride, vinylidene chloride, vinyl bromide, and vinyl fluoride;
(4) vinyl esters such as vinyl acetate, vinyl propionate, and vinyl benzoate;
(5) vinyl ethers such as vinyl methyl ether, vinyl ethyl ether, and vinyl isobutyl ether;
(6) vinyl ketones such as vinyl methyl ketone, vinyl hexyl ketone, and methyl isopropenyl ketone;
(7) N-vinyl compounds such as N-vinylpyrrole, N-vinylcarbazole, N-vinylindole, and N-vinylpyrrolidone;
(8) vinylnaphthalenes;
(9) derivatives of acrylic acid or methacrylic acid such as acrylontrile, methacrylonitrile, and acrylamide;
(10) unsaturated dibasic acids such as maleic acid, citraconic acid, itaconic acid, alkenyl succinic acid, fumaric acid, and mesaconic acid;
(11) unsaturated dibasic acid anhydrides such as maleic acid anhydride, citraconic acid anhydride, itaconic acid anhydride, and alkenyl succinic acid anhydride;
(12) unsaturated dibasic acid monoesters such as monomethyl maleate, monoethyl maleate, monobutyl maleate, monomethyl citraconate, monoethyl citraconate, monobutyl citraconate, monomethyl itaconate, monomethyl alkenyl succinate, monomethyl fumarate, and monomethyl mesaconate;
(13) unsaturated dibasic acid esters such as dimethyl maleate and dimethyl fumarate;
(14) α,β-unsaturated acids such as crotonic acid and cinnamic acid;
(15) α,β-unsaturated acid anhydrides such as crotonic acid anhydride and cinnamic acid anhydride;
(16) anhydrides of α,β-unsaturated acids with lower fatty acids; anhydrides of alkenyl malonic acid, alkenyl glutaric acid, and alkenyl adipic acid; and monoester-like monomers thereof having a carboxyl group;
(17) hydroxyalkyl acrylates and methacrylates such as 2-hydroxyethyl acrylate, 2-hydroxyethyl methacrylate, and 2-hydroxypropyl methacrylate; and
(18) monomers having a hydroxyl group such as 4-(1-hydroxy-1-methylbutyl)styrene and 4-(1-hydroxy-1-methylhexyl)styrene.

The vinyl homopolymers and copolymers of the vinyl monomers may have a cross-linked structure formed using a cross-linking agent having 2 or more vinyl groups. Specific examples of the cross-linking agents having 2 or more vinyl groups include, but are not limited to, aromatic divinyl compounds such as divinylbenzene and divinylnaphthalene; diacrylate (or dimethacrylate) compounds in which acrylates (or methacrylates) are bound together with an alkyl chain (e.g., ethylene glycol diacrylate (or dimethacrylate), 1,3-butylene glycol diacrylate (or dimethacrylate), 1,4-butanediol diacrylate, 1,5-pentanediol diacrylate (or dimethacrylate), 1,6-hexanediol diacrylate (or dimethacrylate), neopentyl glycol diacrylate (or dimethacrylate)); diacrylate (or dimethacrylate) compounds in which acrylates (or methacrylates) are bound together with an alkyl chain having an ether bond (e.g., diethylene glycol diacrylate (or dimethacrylate), triethylene glycol diacrylate (or dimethacrylate), tetraethylene glycol diacrylate (or dimethacrylate), polyethylene glycol #400 diacrylate (or dimethacrylate), polyethylene glycol #600 diacrylate (or dimethacrylate), dipropylene glycol diacrylate (or dimethacrylate)); diacrylate (or dimethacrylate) compounds in which acrylates (or methacrylates) are bound together with a chain having an aromatic group and an ether bond; and polyester diacrylate compounds such as MANDA (from Nippon Kayaku Co., Ltd.)

Specific examples of polyfunctional cross-linking agents include, but are not limited to, pentaerythritol triacrylate, trimethylolethane triacrylate, trimethylolpropane triacrylate, tetramethylolmethane tetraacrylate, oligoester acrylate, pentaerythritol trimethacrylate, trimethylolethane trimethacrylate, trimethylolpropane trimethacrylate, tetramethylolmethane tetramethacrylate, oligoester methacrylate, triacyl cyanurate, and triallyl trimellitate.

The amount of the cross-linking agent is preferably 0.01 to 10 parts by weight based on 100 parts by weight of the monomer. In view of imparting good fixability and hot offset resistance to the resultant toner, aromatic divinyl compounds (particularly divinylbenzene) and diacrylate compounds in which acrylates are bound together with a chain having an aromatic group and an ether bond are preferably used.

Among the above monomers, combinations of monomers which can produce styrene copolymers or styrene-acrylic copolymers are preferably used.

Specific examples of polymerization initiator used for the polymerization of vinyl polymers and copolymers include, but are not limited to, 2,2'-azobisisobutyronitrile, 2,2'-azobis (4-methoxy-2,4-dimethylvaleronitrile), 2,2'-azobis(2,4-dimethylvaleronitrile), 2,2'-azobis(2-methylbutyronitrile), dimethyl-2,2'-azobis isobutyrate, 1,1'-azobis(1-cyclohexanecarbonitrile), 2-(carbamoylazo)-isobutyronitrile, 2,2'-azobis(2,4,4-trimethylpentane), 2-phenylazo-2',4'-dimethyl-4'-methoxyvaleronitrile, 2,2'-azobis(2-methylpropane), ketone peroxides (e.g., methyl ethyl ketone peroxide, acetylacetone peroxide, cyclohexanone peroxide), 2,2-bis(tert-butylperoxy)butane, tert-butyl hydroperoxide, cumene hydroperoxide, 1,1,3,3-tetramethylbutyl hydroperoxide, di-tert-butyl peroxide, tert-butylcumyl peroxide, di-cumyl peroxide, α-(tert-butylperoxy)isopropylbenzene, isobutyl peroxide, octanoyl peroxide, decanoyl peroxide, lauroyl peroxide, 3,5,5-trimethylhexanoyl peroxide, benzoyl peroxide, m-tolyl peroxide, di-isopropylperoxy dicarbonate, di-2-ethylhexylperoxy dicarbonate, di-n-propylperoxy dicarbonate, di-2-ethoxyethylperoxy carbonate, diethoxyisopropylperoxy dicarbonate, di(3-methyl-3-methoxybutyl)peroxy carbonate, acetylcyclohexylsulfonyl peroxide, tert-butylperoxy acetate, ter-butylperoxy isobutylate, tert-butylperoxy-2-ethylhexanoate, tert-butylperoxy laurate, tert-butyloxy benzoate, tert-butylperoxy isopropyl carbonate, di-tert-butylperoxy isophthalate, tert-butylperoxy allyl carbonate, isoamylperoxy-2-ethylhexanoate, di-tert-butylperoxy hexahydroterephthalate, and tert-butylperoxy azelate.

When the binder resin is a styrene-acrylic resin, the THF-soluble components of the styrene-acrylic resin preferably has a molecular weight distribution such that at least one peak is present in each of a number average molecular weight range of from 3,000 to 50,000 and that of not less than 100,000, determined by GPC. In this case, the resultant toner has good fixability, offset resistance, and preservability. A binder resin including THF-soluble components having a molecular weight of not greater than 100,000 in an amount of from 50 to 90% is preferably used. A binder resin having a molecular weight distribution such that a main peak is present in a molecular weight range of from 5,000 to 30,000 is more preferably used. A binder resin having a molecular weight distribution such that a main peak is present in a molecular weight range of from 5,000 to 20,000 is much more preferably used.

When the binder resin is a vinyl polymer such as a styrene-acrylic resin, the resin preferably has an acid value of from 0.1 to 100 mgKOH/g, more preferably from 0.1 to 70 mgKOH/g, and much more preferably from 0.1 to 50 mgKOH/g.

Specific examples of alcohol monomers for preparing the polyester resin include, but are not limited to, diols such as ethylene glycol, propylene glycol, 1,3-bitanediol, 1,4-butanediol, 2,3-butanediol, diethylene glycol, triethylene glycol, 1,5-pentanediol, 1,6-hexanediol, neopentyl glycol, 2-ethyl-1,3-hexanediol, and hydrogenated bisphenol A and bisphenol A to which a cyclic ether such as ethylene oxide and propylene oxide is polymerized.

In order that the polyester resin has a cross-linked structure, polyols having 3 or more valences are preferably used. Specific examples of the polyols having 3 or more valences include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylolethane, trimethylolpropane, and 1,3,5-trihydroxybenzene.

Specific examples of acid monomers for preparing the polyester resin include, but are not limited to, benzene dicarboxylic acids (e.g., phthalic acid, isophthalic acid, terephthalic acid) and anhydrides thereof; alkyl dicarboxylic acids (e.g., succinic acid, adipic acid, sebacic acid, azelaic acid) and anhydrides thereof; unsaturated dibasic acids (e.g., maleic acid, citraconic acid, itaconic acid, alkenylsuccinic acid, fumaric acid, mesaconic acid); and unsaturated dibasic acid anhydrides (e.g., maleic acid anhydride, citraconic acid anhydride, itaconic acid anhydride, alkenylsuccinic acid anhydride).

Polycarboxylic acids having 3 or more valences can also be used. Specific examples of the polycarboxylic acids having 3 or more valences include, but are not limited to, trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxyl)methane, 1,2,7,8-octanetetracarboxylic acid, and anhydrides and partial lower alkyl esters thereof.

When the binder resin is a polyester resin, the THF-soluble components of the polyester resin preferably have a molecular weight distribution such that at least one peak is present in a number average molecular weight range of from 3,000 to 50,000, determined by GPC. In this case, the resultant toner has good fixability and offset resistance. A binder resin including THF-soluble components having a molecular weight of not greater than 100,000 in an amount of from 60 to 100% is preferably used. A binder resin having a molecular weight distribution such that at least one peak is present in a molecular weight range of from 5,000 to 20,000 is more preferably used.

When the binder resin is a polyester resin, the resin preferably has an acid value of from 0.1 to 100 mgKOH/g, more preferably from 0.1 to 70 mgKOH/g, and much more preferably from 0.1 to 50 mgKOH/g.

The vinyl polymer and/or polyester resin used for the present invention may include a monomer unit capable of reacting with both the vinyl polymer and the polyester resin. Specific examples of the monomers for preparing the polyester resin and capable of reacting with the vinyl resin include, but are not limited to, unsaturated dicarboxylic acids (e.g., phthalic acid, maleic acid, citraconic acid, itaconic acid) and anhydrides thereof. Specific examples of the monomers for preparing the vinyl polymer and capable of reacting with the polyester resin include, but are not limited to, monomers having carboxyl group or hydroxy group, acrylates, and methacrylates.

When the binder resin includes the polyester resin and the vinyl polymer in combination with another resin, the binder resin preferably includes resins having an acid value of from 0.1 to 50 mgKOH/g in an amount of not less than 60%.

In the present invention, the acid value of a binder resin of a toner is determined by the following method according to JIS K-0070.

In order to prepare a sample, toner components except the binder resin are previously removed from the toner. Alternatively, if the toner is directly used as a sample, the acid value and weight of the toner components except the binder resin (such as a colorant and a magnetic material) are previously measured, and then the acid value of the binder resin is calculated.

(1) 0.5 to 2.0 g of a pulverized sample is precisely weighed;
(2) the sample is dissolved in 150 ml of a mixture of toluene and ethanol, mixing at a volume ratio of 4/1, in a 300 ml beaker;
(3) the mixture prepared above and the blank each are titrated with a 0.1 mol/l ethanol solution of KOH using a potentiometric titrator; and
(4) the acid value of the sample is calculated from the following equation:

$$AV=[(S-B)\times f\times 5.61]/W$$

wherein AV (mgKOH/g) represents an acid value, S (ml) represents the amount of the ethanol solution of KOH used for the titration of the sample, B (ml) represents the amount of the ethanol solution of KOH used for the titration of the blank, f represents the factor of KOH, and W (g) represents the weight of the binder resin included in the sample.

Each of the binder resin and the toner including the binder resin preferably has a glass transition temperature (Tg) of from 35 to 80° C., and more preferably from 40 to 75° C., from the viewpoint of enhancing preservability of the toner. When the Tg is too small, the toner tends to deteriorate under high temperature atmosphere and cause offset when fixed. When the Tg is too large, fixability of the toner deteriorates.

(Colorant)

Specific examples of the colorants for use in the toner of the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination. The toner preferably includes a colorant in an amount of from 1 to 15% by weight, and more preferably from 3 to 10% by weight.

The colorant for use in the present invention can be combined with a resin to be used as a master batch. Specific examples of the resin for use in the master batch include, but are not limited to, the above-mentioned polyester-based resins, styrene polymers and substituted styrene polymers (e.g., polystyrenes, poly-p-chlorostyrenes, polyvinyltoluenes), styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers), polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination.

The master batches can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading process, dispersing devices capable of applying a high shearing force such as three roll mills can be preferably used.

The toner preferably includes the master batch in an amount of from 0.1 to 20 parts by weight based on 100 parts by weight of the binder resin.

The resin used for the master batch preferably has an acid value of not greater than 30 mgKOH/g and an amine value of from 1 to 100, and more preferably an acid value of not greater than 20 mgKOH/g and an amine value of from 10 to 50. When the acid value is too large, chargeability of the toner deteriorates under high humidity conditions and dispersibility of the colorant deteriorates. When the amine value is too small or large, dispersibility of the colorant deteriorates. The acid value and the amine vale can be measured according to JIS K-0070 and JIS K-7237, respectively.

A colorant dispersing agent can be used in combination with the colorant. The colorant dispersing agent preferably has high compatibility with the binder resin in order to well disperse the colorant. Specific examples of useable commercially available colorant dispersing agents include, but are not limited to, AJISPER® PB-821 and PB-822 (from Ajinomoto-Fine-Techno Co., Inc.), DISPERBYK®-2001 (from BYK-Chemie Gmbh), and EFKA® 4010 (from EFKA Additives BV).

The colorant dispersing agent preferably has a weight average molecular weight, which is a local maximum value of the main peak observed in the molecular weight distribution measured by GPC (gel permeation chromatography) and converted from the molecular weight of styrene, of from 500 to 100,000, more preferably from 3,000 from 100,000, from the viewpoint of enhancing dispersibility of the colorant. In particular, the average molecular weight is preferably from 5,000 to 50,000, and more preferably from 5,000 to 30,000. When the average molecular weight is too small, the dispersing agent has too high a polarity, and therefore dispersibility of the colorant deteriorates. When the average molecular weight is too large, the dispersing agent has too high an affinity for the solvent, and therefore dispersibility of the colorant deteriorates.

The toner preferably includes the colorant dispersing agent in an amount of from 1 to 50 parts by weight, and more preferably from 2 to 30 parts by weight, based on 100 parts by weight of the colorant. When the amount is too small, the colorant cannot be well dispersed. When the amount is too large, chargeability of the resultant toner deteriorates.

(Release Agent)

The toner of the present invention includes a wax as a release agent to prevent the occurrence of offset when fixed.

Any known waxes can be used for the toner of the present invention. Specific examples of the waxes include, but are not limited to, aliphatic hydrocarbon waxes (e.g., low-molecular-weight polyethylene, low-molecular-weight polypropylene, polyolefin wax, microcrystalline wax, paraffin wax, SASOL wax), oxides of aliphatic hydrocarbon waxes (e.g., polyethylene oxide wax) and copolymers thereof, plant waxes (e.g., candelilla wax, carnauba wax, haze wax, jojoba wax), animal waxes (e.g., bees wax, lanoline, spermaceti wax), mineral waxes (e.g., ozokerite, ceresin, petrolatum), waxes including fatty acid esters (e.g., montanic acid ester wax, castor wax) as a main component, and partially or completely deacidified fatty acid esters (e.g., deacidified carnauba wax).

In addition, the following compounds can also be used: saturated straight-chain fatty acids (e.g., palmitic acid, stearic acid, montanic acid, and other straight-chain alkyl carboxylic acid), unsaturated fatty acids (e.g., brassidic acid, eleostearic acid, parinaric acid), saturated alcohols (e.g., stearyl alcohol, behenyl alcohol, ceryl alcohol, melissyl alcohol, and other long-chain alkyl alcohol), polyols (e.g., sorbitol), fatty acid amides (e.g., linoleic acid amide, olefin acid amide, lauric acid amide), saturated fatty acid bisamides (e.g., methylenebis capric acid amide, ethylenebis lauric acid amide, hexamethylenebis capric acid amide), unsaturated fatty acid amides (e.g., ethylenebis oleic acid amide, hexamethylenebis oleic acid amide, N,N'-dioleyl adipic acid amide, N,N'-dioleyl sebacic acid amide), aromatic biamides (e.g., m-xylenebis stearic acid amide, N,N-distearyl isophthalic acid amide), metal salts of fatty acids (e.g., calcium stearate, calcium laurate, zinc stearate, magnesium stearate), alophatic hydrocarbon waxes to which a vinyl monomer such as styrene and an acrylic acid is grafted, partial ester compounds between a fatty acid such as behenic acid monoglyceride and a polyol, and methyl ester compounds having a hydroxyl group obtained by hydrogenating plant fats.

In particular, the following compounds are preferably used: a polyolefin obtained by radical polymerizing an olefin under high pressure; a polyolefin obtained by purifying low-molecular-weight by-products of a polymerization reaction of a high-molecular-weight polyolefin; a polyolefin polymerized under low pressure in the presence of a Ziegler catalyst or a metallocene catalyst; a polyolefin polymerized using radiation, electromagnetic wave, or light; a low-molecular-weight polyolefin obtained by thermally decomposing a high-molecular-weight polyolefin; paraffin wax; microcrystalline wax; Fischer-Tropsch wax; synthesized hydrocarbon waxes; synthesized waxes including a compound having one carbon atom as a monomer unit; hydrocarbon waxes having a functional group such as hydroxyl group and carboxyl group; mixtures of a hydrocarbon wax and that having a functional group; and these waxes to which a vinyl monomer such as styrene, a maleate, an acrylate, a methacrylate, and a maleic anhydride is grafted.

Among these waxes, carnauba wax, synthesized ester wax, paraffin wax are most preferably used in view of preventing the occurrence of offset.

In addition, these waxes subjected to a press sweating method, a solvent method, a recrystallization method, a vacuum distillation method, a supercritical gas extraction method, or a solution crystallization method, so as to much more narrow the molecular weight distribution thereof are preferably used. Further, low-molecular-weight solid fatty acids, low-molecular-weight solid alcohols, low-molecular-weight solid compounds, and other compounds from which impurities are removed are preferably used.

The wax preferably has a melting point of from 70 to 140° C., and more preferably from 70 to 120° C., so that the resultant toner has a good balance of toner blocking resistance and offset resistance. When the melting point is too small, toner blocking resistance deteriorates. When the melting point is too large, offset resistance deteriorates.

When two or more waxes are used in combination, functions of both plasticizing and releasing simultaneously appear.

As a wax having a function of plasticizing, for example, a wax having a low melting point, a wax having a branched structure, and a wax having a polar group can be used.

As a wax having a function of releasing, for example, a wax having a high melting point, a wax having a straight-chain structure, and a nonpolar wax having no functional group can be used.

For example, a combination of two waxes having the difference in melting point of from 10 to 100° C., and a combination of a polyolefin and a grafted polyolefin are preferable.

When two waxes having a similar structure are used in combination, a wax having relatively lower melting point exerts a function of plasticizing and the other wax having a relatively higher lower melting point exerts a function of releasing. When the difference in melting point between the two waxes is from 10 to 100° C., these functions are efficiently separately expressed. When the difference is too small, these functions are not efficiently separately expressed. When the difference is too large, each of the functions is hardly enhanced by their interaction. It is preferable that one wax has a melting point of from 70 to 120° C., more preferably from 70 to 100° C.

As mentioned above, a wax having a branched structure, a wax having a polar group such as a functional group, and a wax modified with a component different from the main component of the wax relatively exerts a function of plasticizing. On the other hand, a wax having a straight-chain structure, a nonpolar wax having no functional group, and an unmodified wax relatively exerts a function of releasing. Specific preferred examples of combinations of waxes include, but are not limited to, a combination of a polyethylene homopolymer or copolymer including ethylene as a main component, and a polyolefin homopolymer or copolymer including an olefin other than ethylene as a main component; a combination of a polyolefin and a graft-modified polyolefin; a combination of a hydrocarbon wax and one member selected from an alcohol wax, a fatty acid wax, and an ester wax, and; a combination of a Fischer-Tropsch wax or a polyolefin wax, and a paraffin wax or a microcrystalline wax; a combination of a Fischer-Tropsch wax and a polyolefin wax; a combination of a paraffin wax and a microcrystalline wax; and a combination of a hydrocarbon wax and one member selected from a carnauba wax, a candelilla wax, a rice wax, and a montan wax.

The toner preferably has a maximum endothermic peak in a temperature range of from 70 to 110° C. of the endothermic curve measured by DSC (differential scanning calorimetry). In this case, the toner has a good balance of preservability and fixability.

The toner preferably includes the wax in an amount of from 0.2 to 20 parts by weight, more preferably from 0.5 to 10 parts by weight, based on 100 parts by weight of the binder resin.

In the present invention, the melting point of a wax is defined as a temperature in which the maximum endothermic peak is observed in an endothermic curve measured by DSC.

As a DSC measurement instrument, a high-precision inner-heat power-compensation differential scanning calorimeter is preferably used. The measurement is performed according to ASTM D3418-82. The endothermic curve is obtained by heating a sample at a temperature increasing rate of 10° C./min, after once heated and cooled the sample.

(Graft Polymer)

The graft polymer for use in the present invention has a structure such that a vinyl resin is grafted to a polyolefin resin. As the vinyl resin, any known homopolymers and copolymers of a vinyl monomer can be used.

In the toner of the present invention, the release agent is at least partially incorporated into or adhered to the graft polymer.

The graft polymer prevents fine particles of the release agent from migrating and re-aggregating in the toner constituent liquid. This is because the polyolefin resin portion of the graft polymer has a high affinity for the release agent, while the vinyl resin portion has a high affinity for the binder resin, resulting in generating dispersing effect of the release agent.

In terms of preventing the occurrence of hole clogging, the dispersion diameter of the graft polymer and the release agent is preferably not greater than half of the opening diameter of the hole.

Specific examples of the olefins composing the polyolefin resin include, but are not limited to, ethylene, propylene, 1-butene, isobutylene, 1-hexene, 1-dodecene, and 1-octadecene.

As the polyolefin resin, polymers of an olefin (hereinafter referred to as olefin polymer), oxides of olefin polymer, modified olefin polymer, and copolymers of an olefin with other monomer capable of copolymerizing with the olefin can be used.

Specific examples of the olefin polymers include, but are not limited to, polyethylene, polypropylene, ethylene/propylene copolymer, ethylene/1-butene copolymer, and propylene/1-hexene copolymer.

Specific examples of the oxides of olefin polymers include, but are not limited to, oxides of polymers of the above-mentioned olefins.

Specific examples of the modified olefin polymers include, but are not limited to, maleic acid derivative adducts of polymers of the above-mentioned olefins. Specific examples of the maleic acid derivative adducts include, but are not limited to, maleic anhydride, monomethyl maleate, monobutyl maleate, and dimethyl maleate.

Thermally degraded olefin polymer can also be preferably used. The thermally degraded olefin polymer is a polyolefin resin obtained by thermally degraded a polyolefin resin (such as polyethylene and polypropylene) having a weight average molecular weight of from 50,000 to 5,000,000 at a temperature of from 250 to 450° C. The resultant thermally degraded polyolefin resin preferably includes double bonds in an amount of from 30 to 70% per one molecule, which is calculated from the number average molecular weight thereof.

Specific examples of the copolymers of an olefin with other monomer capable of copolymerizing with the olefin include, but are not limited to, copolymers of an unsaturated carboxylic acid or an alkyl ester thereof with an olefin. Specific examples of the unsaturated carboxylic acids include, but are not limited to, (meth)acrylic acid, itaconic acid, and maleic anhydride Specific examples of the alkyl esters of the unsaturated carboxylic acid include, but are not limited to, alkyl ester of a (meth)acrylic acid having 1 to 18 carbon atoms, and alkyl esters of maleic acid having 1 to 18 carbon atoms.

In the present invention, the polyolefin resin does not need to be formed from an olefin monomer, so long as the resultant polymer (i.e., the polyolefin resin) has a polyolefin structure. Therefore, a polymethylene such as SASOL wax, for example, can be used as a monomer for preparing the polyolefin resin.

Among the above polyolefin resins, olefin polymers, thermally degraded olefin polymers, oxides of olefin polymers, and modified olefin polymers are preferably used; polyethylene, polymethylene, polypropylene, and ethylene/propylene copolymer and thermally degraded compounds thereof, oxidized polyethylene, oxidized polypropylene, and maleinated polypropylene are more preferably used; and thermally degraded polyethylene and polypropylene are much more preferably used.

The polyolefin resin typically has a softening point of from 60 to 170° C., and preferably from 70 to 150° C. When the softening point is greater than 70° C., fluidity of the resultant toner increases. When the softening point is less than 150° C., the resultant toner has good separating ability.

The polyolefin resin typically has a number average molecular weight of from 500 to 20,000 and a weight average molecular weight of from 800 to 100,000, preferably a number average molecular weight of from 1,000 to 15,000 and a weight average molecular weight of from 1,500 to 60,000, and more preferably a number average molecular weight of from 1,500 to 10,000 and a weight average molecular weight of from 2,000 to 30,000, from the viewpoint of preventing the formation of toner film on the carrier and enhancing separativeness of the resultant toner.

As the vinyl monomer for grafting to the polyolefin resin, homopolymers and copolymers of any known vinyl monomers can be used.

Specific examples of the vinyl monomers include, but are not limited to, styrene monomers (e.g., styrene, α-methylstyrene, p-methylstyrene, m-methylstyrene, p-methoxystyrene, p-hydroxystyrene, p-acetoxystyrene, vinyltoluene, ethylstyrene, phenylstyrene, benzylstyrene), alkyl esters of unsaturated carboxylic acids having 1 to 18 carbon atoms (e.g., methyl(meth)acrylate, ethyl(meth)acrylate, butyl(meth)acrylate, and 2-ethylhexyl(meth)acrylate), vinyl ester monomers (e.g., vinyl acetate), vinyl ether monomers (e.g., vinyl methyl ether), vinyl monomers containing a halogen atom (e.g., vinyl chloride), diene monomers (e.g., butadiene, isobutylene), and unsaturated nitrile monomers (e.g., (meth)acrylonitrile, cyanostyrene). These can be used alone or in combination.

Among these, styrene monomers, alkyl esters of unsaturated carboxylic acids, (meth)acrylonitrile, and combinations thereof are preferably used; and styrene, and a combination of styrene and an alkyl ester of (meth)acrylic acid or (meth) acrylonitrile are more preferably used.

The vinyl resin preferably has an SP (i.e., solubility parameter) value of from 10.0 to 11.5 $(cal/cm^3)^{1/2}$. The SP value of the vinyl resin is controlled considering that of the binder resin. The SP value can be calculated by Fedors method.

The vinyl resin typically has a number average molecular weight of from 1,500 to 100,000 and a weight average molecular weight of from 5,000 to 200,000, preferably a number average molecular weight of from 2,500 to 50,000 and a weight average molecular weight of from 6,000 to 100,000, and more preferably a number average molecular weight of from 2,800 to 20,000 and a weight average molecular weight of from 7,000 to 50,000.

The vinyl resin typically has a glass transition temperature (Tg) of from 40 to 90° C., preferably from 45 to 80° C., and more preferably from 50 to 70° C. When the Tg is not less than 40° C., preservability of the resultant toner improves. When the Tg is not greater than 90° C., low-temperature fixability of the resultant toner improves.

The graft polymer for use in the present invention has a structure such that a vinyl resin is grafted to a polyolefin resin, and prepared by any known methods.

For example, such a graft polymer is prepared as follows:

dissolving a polyolefin resin, which composes a main chain of the resultant graft polymer, in an organic solvent;

dissolving a vinyl monomer, which forms a vinyl resin grafted to the polyolefin resin, therein;

graft-polymerizing the polyolefin resin and the vinyl monomer in the organic solvent in the presence of a polymerization initiator such as an organic peroxide.

The weight ratio of the polyolefin resin to the vinyl monomer is preferably from 1/99 to 30/70, and more preferably from 2/98 to 27/83, from the viewpoint of preventing the occurrence of filming problem.

The graft polymer may include unreacted polyolefin resin and vinyl resin which is not grafted. In the present invention, the unmodified polyolefin resin and vinyl resin which is not grafted do not need to be removed, and such a graft polymer is rather preferably used as a mixed resin.

The mixed resin preferably includes the unreacted polyolefin resin in an amount of not greater than 5% by weight, and more preferably not less than 3% by weight, and the vinyl resin which is not grafted in an amount of not greater than 10% by weight, and more preferably not greater than 5% by weight. In the present invention, the mixed resin preferably includes the graft polymer in an amount of not less than 85% by weight, and more preferably not less than 90% by weight.

The ratio of the graft polymer in the mixed resin, the molecular weights of the graft polymer and the vinyl resin, etc., can be varied by controlling the composition of raw materials, the reaction temperature, the reaction time, etc.

Specific examples of the graft polymers include, but are not limited to, graft polymers including the following combinations of (A) a polyolefin resin unit and (B) a vinyl resin unit.

(1) (A) oxidized polypropylene and (B) styrene/acrylonitrile copolymer;
(2) (A) polyethylene/polypropylene mixture and (B) styrene/acrylonitrile copolymer;
(3) (A) ethylene/propylene copolymer and (B) styrene/acrylic acid/butyl acrylate copolymer
(4) (A) polypropylene and (B) styrene/acrylonitrile/butyl acrylate/monobutyl maleate copolymer;
(5) (A) maleinated polypropylene and (B) styrene/acrylonitrile/acrylic acid/butyl acrylate copolymer;
(6) (A) maleinated polypropylene and (B) styrene/acrylonitrile/acrylic acid/2-ethylhexyl acrylate copolymer; and
(7) (A) polyethylene/maleinated polypropylene mixture and (B) acrylonitrile/butyl acrylate/styrene/monobutyl maleate copolymer.

The graft polymer can be prepared as follows, for example:

dissolving or dispersing a wax such as a polyolefin resin in a solvent such as toluene and xylene;

heating the mixture to a temperature of from 100 to 200° C.;

adding a vinyl monomer and a peroxide polymerization initiator thereto; and removing the solvent.

Specific examples of the peroxide initiator include, but are not limited to, benzoyl peroxide, di-tert-butyl peroxide, and tert-butyl peroxide benzoate.

The amount of the peroxide initiator is typically from 0.2 to 10% by weight, and preferably from 0.5 to 5% by weight, based on total weight of the raw materials.

As mentioned above, the graft polymer may include unreacted polyolefin resin and vinyl resin which is not grafted. In the present invention, the unmodified polyolefin resin and vinyl resin which is not grafted do not need to be removed, and such a graft polymer is rather preferably used as a mixed resin.

The graft polymer typically includes the polyolefin resin unit in an amount of from 1 to 90% by weight, and preferably from 5 to 80% by weight. The graft polymer typically includes the vinyl resin unit in an amount of from 10 to 99% by weight, and preferably from 20 to 95% by weight.

The toner typically includes the graft polymer, including unreacted polyolefin resin and vinyl resin which is not grafted, in an amount of from 5 to 300 parts by weight, and preferably from 10 to 150 parts by weight, based on 100 parts by weight of the release agent, from the viewpoint of stably dispersing the release agent.

(Magnetic Material)

As the magnetic materials for use in the toner of the present invention, the following compounds can be used: (1) magnetic iron oxides (e.g., magnetite, magnetite, ferrite) and iron oxides including other metal oxides; (2) metals (e.g., iron, cobalt, nickel) and metal alloys of the above metals with aluminum, cobalt, copper, lead, magnesium, tin, zinc, antimony, beryllium, bismuth, cadmium, calcium, manganese, selenium, titanium, tungsten, vanadium, etc.; and (3) mixtures thereof.

Specific examples of the magnetic materials include, but are not limited to, $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder, and nickel powder. These can be used alone or in combination. Among these, powders of $Fe_3O_4$ and $\gamma$-$Fe_2O_3$ are preferably used.

In addition, magnetic iron oxides (e.g., magnetite, magnetite, ferrite) containing a dissimilar element and mixtures thereof can also be used. Specific examples of the dissimilar elements include, but are not limited to, lithium, beryllium, boron, magnesium, aluminum, silicon, phosphorus, germanium, zirconium, tin, sulfur, calcium, scandium, titanium, vanadium, chromium, manganese, cobalt, nickel, copper, zinc, and gallium. Among these, magnesium, aluminum, silicon, phosphorus, and zirconium are preferably used. The dissimilar element may be incorporated into the crystal lattice of an iron oxide; the oxide thereof may be incorporated into an iron oxide; or the oxide or hydroxide thereof may be present at the surface of an iron oxide. However, it is preferable that the oxide of the dissimilar element is incorporated into an iron oxide.

The dissimilar element is incorporated into a magnetic iron oxide by mixing a salt of the dissimilar element and the magnetic iron oxide and controlling the pH. The dissimilar element is deposited out on the surface of a magnetic iron oxide by adding a salt of the dissimilar element and controlling the pH.

The toner preferably includes the magnetic material in an amount of from 10 to 200 parts by weight, and more preferably from 20 to 150 parts by weight, based on 100 parts by weight of the binder resin. The magnetic material preferably has a number average particle diameter of from 0.1 to 2 μm, and more preferably from 0.1 to 0.5 μm. The number average particle diameter can be determined from a magnified photographic image obtained by a transmission electron microscope using a digitizer.

The magnetic material preferably has a coercive force of from 20 to 150 oersted, a saturation magnetization of from 50 to 200 emu/g, and a residual magnetization of from 2 to 20 emu/g, when 10K oersted of magnetic field is applied.

The magnetic material can also be used as a colorant.

(Charge Controlling Agent)

The toner of the present invention may optionally include a charge controlling agent.

Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto.

Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner increases, resulting in deterioration of the fluidity of the toner and image density of the toner images.

The charge controlling agent and the release agent can be melt-kneaded with the master batch or the binder resin, or directly added to the organic solvent.

(Fluidity Improving Agent)

The toner of the present invention may include a fluidity improving agent, which enables the resultant toner to easily fluidize by being added to the surface of the toner.

Specific examples of the fluidity improving agents include, but are not limited to, fine powders of fluorocarbon resins such as vinylidene fluoride and polytetrafluoroethylene; fine powders of silica prepared by a wet process or a dry process, titanium oxide, and alumina; and these silica, titanium oxide, and alumina surface-treated with a silane-coupling agent, a titanium-coupling agent, or a silicone oil. Among these, fine powders of silica, titanium oxide, and alumina are preferably used, and the silica surface-treated with a silane-coupling agent or a silicone oil is more preferably used.

The fluidity improving agent preferably has an average primary particle diameter of from 0.001 to 2 μm, and more preferably from 0.002 to 0.2 μm.

A fine powder of silica is prepared by a vapor phase oxidization of a halogenated silicon compound, and typically called a dry process silica or a fumed silica.

Specific examples of useable commercially available fine powders of silica prepared by a vapor phase oxidization of a halogenated silicon compound include, but are not limited to, AEROSIL® 130, 300, 380, TT600, MOX170, MOX80, and COK84 (from Nippon Aerosil Co., Ltd.), CAB-O-SIL® M-5, MS-7, MS-75, HS-5, and EH-5 (from Cabot Corporation), WACKER HDK® N20, V15, N20E, T30, and T40 (from Wacker Chemie Gmbh), Dow Corning® Fine Silica (from Dow Corning Corporation), and FRANSIL (from Fransol Co.).

A hydrophobized fine powder of silica prepared by a vapor phase oxidization of a halogenated silicon compound is more preferably used. The hydrophobized silica preferably has a hydrophobized degree of from 30 to 80%, measured by a methanol titration test. The hydrophobic property is imparted to a silica when an organic silicon compound is reacted with or physically adhered to the silica. A hydrophobizing method in which a fine powder of silica prepared by a vapor phase oxidization of a halogenated silicon compound is treated with an organic silicon compound is preferable.

Specific examples of the organic silicon compounds include, but are not limited to, hydroxypropyltrimethoxysilane, phenyltrimethoxysilane, n-hexadecyltrimethoxysilane, n-octadecyltrinethoxysilane, vinyltrimethoxysilane, vinyltriethoxysilane, vinyltriacetoxysilane, dimethylvinylchlorosilane, divinylchlorosilane, γ-methacryloxypropyltrimethoxysilane, hexamethyldisilazane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinyltetramethyldisiloxane, 1,3-diphenyltetramethyldisiloxane, dimethylpolysiloxane having 2 to 12 siloxane units per molecule and 0 to 1 hydroxyl group bound to Si in the end siloxane units, and silicone oils such as dimethyl silicone oil. These can be used alone or in combination.

The fluidity improving agent preferably has a number average particle diameter of from 5 to 100 nm, and more preferably from 5 to 50 nm.

The fluidity improving agent preferably has a specific surface area of not less than 30 $m^2/g$, and more preferably from 60 to 400 $m^2/g$, measured by nitrogen adsorption BET method.

The surface-treated fluidity improving agent preferably has a specific surface area of not less than 20 $m^2/g$, and more preferably from 40 to 300 $m^2/g$, measured by nitrogen adsorption BET method.

The toner preferably includes the fluidity improving agent in an amount of from 0.03 to 8 parts by weight based on 100 parts by weight of the toner.

(Cleanability Improving Agent)

A cleanability improving agent is added to the toner so as to remove toner particles remaining on the surface of a photoreceptor or a primary transfer medium after a toner image is transferred onto a recording paper, etc. Specific examples of the cleanability improving agents include, but are not limited to, fatty acids and metal salts thereof such as stearic acid, zinc stearate, and calcium stearate; and particulate polymers such as polymethyl methacrylate and polystyrene, which are manufactured by a method such as soap-free emulsion polymerization methods. Particulate resins having a relatively narrow particle diameter distribution and a volume average particle diameter of from 0.01 μm to 1 μm are preferably used as the cleanability improving agent.

The fluidity improving agent and the cleanability improving agent are fixed on the surface of mother toner particles. Therefore, these agents are called external additives. Suitable mixers for use in mixing the mother toner particles and the external additive include known mixers for mixing powders. Specific examples of the mixers include V-form mixers, locking mixers, Loedge Mixers, NAUTER MIXERS, HENSCHEL MIXERS and the like mixers. When fixing the external additive on the surface of the mother toner particles, HYBRIDIZER, MECHANOFUSION, Q-TYPE MIXER, etc. can be used.

(Carrier)

The toner of the present invention can be mixed with a carrier so as to be used for a two-component developer. As the carrier, typical ferrite, magnetite, and a carrier covered with a resin (hereinafter referred to as resin-covered carrier) can be used.

The resin-covered carrier comprises a core and a covering material (i.e., resin) which covers the surface of the core.

Specific examples of the resins used for the covering material include, but are not limited to, styrene-acrylic resins (e.g., styrene-acrylate copolymer, styrene-methacrylate copolymer), acrylic resins (e.g., acrylate copolymer, methacrylate copolymer), fluorocarbon resins (e.g., polytetrafluoroethylene, monochlorotrifluoroethylene polymer, polyvinylidene fluoride), silicone resin, polyester resin, polyamide resin, polyvinyl butyral, aminoacrylate resin, ionomer resin, polyphenylene sulfide resin. These can be used alone or in combination.

A core in which a magnetic powder is dispersed in a resin can also be used.

Specific examples of methods for covering the surface of a core with a covering material (i.e., resin) include a method in which a solution or suspension of the resin is coated on the core, and a method in which the powder resin is mixed with the resin.

The resin-covered carrier preferably includes the covering material in an amount of from 0.01 to 5% by weight, and more preferably from 0.1 to 1% by weight.

As a covering material, mixtures of two or more compounds can also be used. For example, (1) 100 parts by weight of a titanium oxides treated with 12 parts by weight of a mixture of dimethyldichlorosilane and dimethyl silicone oil (mixing weight ratio is 1/5) and (2) 100 parts by weight of a silica treated with 20 parts by weight of a mixture of dimethyldichlorosilane and dimethyl silicone oil (mixing weight ratio is 1/5) can be used.

Among the above-mentioned resins, styrene-methyl methacrylate copolymer, mixtures of a fluorocarbon resin and a styrene copolymer, and silicone resin are preferably used, and silicone resin are more preferably used.

Specific examples of the mixtures of a fluorocarbon resin and a styrene copolymer include, but are not limited to, a mixture of polyvinylidene fluoride and styrene/methyl methacrylate copolymer; a mixture of polytetrafluoroethylene and styrene/methyl methacrylate copolymer; and a mixture of vinylidene fluoride/tetrafluoroethylene copolymer (copolymerization ratio is from 10:90 to 90:10 by weight), styrene/2-ethylhexyl acrylate copolymer (copolymerization ratio is from 10:90 to 90:10 by weight), and styrene/2-ethylhexyl acrylate/methyl methacrylate copolymer (copolymerization ratio is (20 to 60):(5 to 30):(10 to 50) by weight).

Specific examples of the silicone resins include, but are not limited to, a silicone resin containing nitrogen and a modified silicone resin formed by reacting a silane-coupling agent containing nitrogen with a silicone resin.

Magnetic materials used for the core include, but are not limited to, oxides such as ferrite, iron excess ferrite, magnetite, and γ-iron oxide; metals such as iron, cobalt, an nickel and alloys thereof.

Specific examples of the elements included in these magnetic materials include, but are not limited to, iron, cobalt, nickel, aluminum, copper, lead, magnesium, tin, zinc, antimony, beryllium, bismuth, calcium, manganese, selenium, titanium, tungsten, and vanadium. Among these, Cu—Zn—Fe ferrites including copper, zinc, and iron as main components and Mn—Mg—Fe ferrites including manganese, magnesium, and iron as main components are preferably used.

The carrier preferably has a resistivity of from $10^6$ to $10^{10}$ Ω·cm by controlling the roughness and of the surface and the amount of the covering resin.

The carrier typically has a particle diameter of from 4 to 200 μm, preferably from 10 to 150 μm, and more preferably from 20 to 100 μm. The resin-covered carrier preferably has a 50% particle diameter of from 20 to 70 μm.

The two-component developer preferably includes the toner of the present invention in an amount of from 1 to 200 parts by weight, and more preferably 2 to 50 parts by weight, based on 100 parts by weight of the carrier.

When the toner of the present invention is developed, any known electrostatic latent image bearing members used for electrophotography can be used. For example, organic image bearing member, amorphous silica image bearing member, selenium image bearing member, zinc oxide image bearing member, etc. can be preferably used.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Manufacturing Example of Graft Polymer 1

In an autoclave reaction vessel equipped with a thermometer and a stirrer, 480 parts of xylene and 100 parts of a low-molecular-weight polyethylene (SANWAX® LEL-400 from Sanyo Chemical Industries, Ltd., having a melting point of 128° C.) are contained and mixed. The atmosphere in the reaction vessel is replaced with nitrogen. Next, a mixture liquid of 755 parts of styrene, 100 parts of acrylonitrile, 45 parts of butyl acrylate, 21 parts of acrylic acid, 36 parts of di-t-butyl peroxyhexahydroterephthalate, and 100 parts of xylene is dropped therein over a period of 3 hours at 170° C. so as to be polymerized, and then left for 0.5 hours. The solvent (xylene) is removed therefrom.

Thus, a graft polymer (W-1) having a number average molecular weight of 3,300, a weight average molecular weight of 18,000, a glass transition temperature of 65.0° C., and an SP value of the vinyl resin of 11.0 $(cal/cm^3)^{1/2}$ is prepared.

Manufacturing Example of Graft Polymer 2

In an autoclave reaction vessel equipped with a thermometer and a stirrer, 450 parts of xylene and 200 parts of a low-molecular-weight polyethylene (VISCOL® 440P from Sanyo Chemical Industries, Ltd., having a melting point of 153° C.) are contained and mixed. The atmosphere in the reaction vessel is replaced with nitrogen. Next, a mixture liquid of 280 parts of styrene, 520 parts of methyl methacrylate, 32.3 parts of di-t-butyl peroxyhexahydroterephthalate, and 120 parts of xylene is dropped therein over a period of 2 hours at 150° C. so as to be polymerized, and then left for 1 hour. The solvent (xylene) is removed therefrom.

Thus, a graft polymer (W-2) having a number average molecular weight of 3,300, a weight average molecular weight of 16,000, a glass transition temperature of 58.8° C., and an SP value of the vinyl resin of 10.2 $(cal/cm^3)^{1/2}$ is prepared.

Manufacturing Example of Graft Polymer 3

In an autoclave reaction vessel equipped with a thermometer and a stirrer, 450 parts of xylene and 150 parts of a mixture (LICOCENE® 1302 from Clariant Japan K. K., having a melting point of 78.9° C.) of a low-molecular-weight polypropylene and a low-molecular-weight polyethylene are contained and mixed. The atmosphere in the reaction vessel is replaced with nitrogen. Next, a mixture liquid of 200 parts of styrene, 460 parts of methyl methacrylate, 140 parts of acrylonitrile, 35 parts of di-t-butyl peroxyhexahydro terephthalate, and 120 parts of xylene is dropped therein over a period of 2 hours at 150° C. so as to be polymerized, and then left for 1 hour. The solvent (xylene) is removed therefrom.

Thus, a graft polymer (W-3) having a number average molecular weight of 2,400, a weight average molecular weight of 14,000, a glass transition temperature of 88.5° C., and an SP value of the vinyl resin of 11.5 $(cal/cm^3)^{1/2}$ is prepared.

Example 1

Preparation of Colorant Dispersion

At first, 20 parts of a carbon black (REGAL® 400 from Cabot Corporation) and 2 parts of a colorant dispersing agent (AJISPER® PB-821 from Ajinomoto Fine-Techno Co., Inc.) are primarily dispersed in 78 parts of ethyl acetate using a mixer equipped with agitation blades. Thus, a primary dispersion is prepared.

The primary dispersion is subjected to a dispersing treatment using a DYNO-MILL so that the colorant (i.e., carbon black) is much finely dispersed and aggregations thereof are completely removed by applying a strong shear force. Thus, a secondary dispersion is prepared.

The secondary dispersion is filtered with a filter (made of PTFE) having 0.45 μm-sized fine pores. Thus, a colorant dispersion is prepared.

Preparation Resin & Wax Dispersion

In a vessel equipped with a stirrer and a thermometer, 186 parts of a polyester resin (having a weight average molecular weight of 20,000), 10 parts of a carnauba wax, 4 parts of the graft polymer (W-1), and 2,000 parts of ethyl acetate are contained. The mixture is heated to 85° C. and mixed for 20 minutes so that the polyester resin and the carnauba wax are dissolved, and then rapidly cooled so that particles of the carnauba wax separate out. The mixture is subjected to a dispersing treatment using a DYNO-MILL so that the wax is much finely dispersed. Thus, a resin & wax dispersion is prepared.

Preparation of Toner Constituent Liquid

At first, 30 parts of the colorant dispersion and 1,100 parts of the resin & wax dispersion are mixed using a mixer equipped with agitation blades. The mixture is further diluted with ethyl acetate so that the resultant mixture includes solid components in an amount of 6.0%. Thus, a toner constituent liquid is prepared.

Preparation of Toner

The toner constituent liquid is supplied to the retention part 101 of the toner manufacturing device 100 illustrated in FIG. 2. As "the plate including plural holes", a nickel plate having a thickness of 20 μm on which 500 circular holes having an opening diameter of 8.0 μm are concentrically arranged is used. The holes are formed by a laser ablation method in which a mask is reduced-projected by a femtosecond laser. The holes are formed in a region having a substantially square shape, with each side having a length of 0.5 mm.

Liquid droplets of the toner constituent liquid are formed under the following conditions, and then the liquid droplets are dried to solidify.

Solid component concentration of liquid: 6%

Flow rate of liquid: 400 ml/hr

Flow late of dried air: 2.0 L/min (sheath air), 20 L/min (inner air)

Inner temperature: 27 to 28° C.

Dew-point temperature: −20° C.

Vibration frequency: 601.0 kHz

Thus, mother toner particles are prepared.

Although the mother toner particles are continuously produced for 5 hours, hole clogging never occurs.

The dried mother toner particles are collected using a cyclone collector. Next, 100 parts by weight of the mother toner particles are mixed with 0.7 parts by weight of a hydrophobized silica (H2000 from Clariant Japan KK.) using a HENSCHEL MIXER (from Mitsui Mining Co., Ltd.). Thus, a black toner (a1) is prepared.

The toner (a1) has a complete monodisperse particle diameter distribution such that the weight average particle diameter (D4) is 5.9 μm and the number average particle diameter (Dn) is 5.9 μm.

Preparation of Carrier

The following components are mixed for 20 minutes using a HOMOMIXER to prepare a cover layer formation liquid.

| | |
|---|---|
| Silicone resin (Organo straight silicone) | 100 parts |
| Toluene | 100 parts |
| γ-(2-Aminoethyl)aminopropyl trimethoxysilane | 5 parts |
| Carbon black | 10 parts |

The cover layer formation liquid is applied on the surfaces of 100 parts of spherical magnetite particles having a particle diameter of 50 μm using a fluidized bed coating device. Thus, a magnetic carrier (A) is prepared.

Preparation of Developer

To evaluate resistance to hot offset and filming problem, a two-component developer (1) is prepared by mixing 4 parts of the toner (a1) and 96 parts of the magnetic carrier (A).

Example 2

The procedure for preparation of the toner and developer in Example 1 is repeated except that the carnauba wax is replaced with a synthesized ester wax (WEP-5 from NOF Corporation).

Example 3

The procedure for preparation of the toner and developer in Example 1 is repeated except that the carnauba wax is replaced with a paraffin wax (HNP-9 from Nippon Seiro Co., Ltd.).

Example 4

The procedure for preparation of the toner and developer in Example 1 is repeated except that the graft polymer (W-1) is replaced with the graft polymer (W-2).

Example 5

The procedure for preparation of the toner and developer in Example 1 is repeated except that the graft polymer (W-1) is replaced with the graft polymer (W-3).

Example 6

The procedure for preparation of the toner and developer in Example 1 is repeated except that the amount of the graft polymer (W-1) is changed to 1 part.

Example 7

The procedure for preparation of the toner and developer in Example 1 is repeated except that the amount of the graft polymer (W-1) is changed to 15 parts.

Comparative Example 1

The procedure for preparation of the toner and developer in Example 1 is repeated except that the carnauba wax and the graft polymer (W-1) are not added, and the amount of the polyester resin is changed to 200 parts.

Comparative Example 2

The procedure for preparation of the toner and developer in Example 1 is repeated except that the graft polymer (W-1) is not added, and the amount of the polyester resin is changed to 196 parts.

Comparative Example 3

The procedure for preparation of the toner and developer in Example 2 is repeated except that the graft polymer (W-1) is not added, and the amount of the polyester resin is changed to 196 parts.

Comparative Example 4

The procedure for preparation of the toner and developer in Example 3 is repeated except that the graft polymer (W-1) is not added, and the amount of the polyester resin is changed to 196 parts.

Example 8

The procedure for preparation of the mother toner particles in Example 1 is repeated except that the toner constituent liquid is supplied to the head of the ring vibrator of the toner manufacturing device 1B illustrated in FIG. 14.

As "the thin film including plural holes", a nickel plate having an outer diameter of 8.0 mm and a thickness of 20 μm on which plural circular holes having an opening diameter of 8.0 μm are arranged is used. The holes are formed by electroforming. The holes are formed in the central region having a substantially circular shape having a diameter of about 5 mm, so that the distance between each of the holes is 100 μm (like hound's-tooth check).

As the piezoelectric substance, laminated lead zirconate titanate (PZT) is used. The vibration frequency is 100 kHz.

Liquid droplets of the toner constituent liquid are formed under the following conditions, and then the liquid droplets are dried to solidify.

Flow rate of dried air: 2.0 L/min (nitrogen gas for dispersion), 30.0 L/min (inner dried nitrogen gas)

Inner temperature: 27 to 28° C.

Dew-point temperature: −20° C.

Vibration frequency: 98 kHz

Thus, mother toner particles are prepared.

Although the mother toner particles are continuously produced for 5 hours, hole clogging never occurs.

The dried mother toner particles are suction-collected using a filter having 1 μm-sized fine pores. Next, 100 parts by weight of the mother toner particles are mixed with 1.0 parts by weight of a hydrophobized silica (H2000 from Clariant Japan K. K.) using a HENSCHEL MIXER (from Mitsui Mining Co., Ltd.). Thus, a black toner (a2) is prepared.

The toner (a2) has a very narrow particle diameter distribution such that the weight average particle diameter (D4) is 5.3 μm and the ratio (D4/Dn) is 1.02.

To evaluate resistance to hot offset and filming problem, a two-component developer (2) is prepared by mixing 4 parts of the toner (a2) and 96 parts of the magnetic carrier (A).

Example 9

The procedure for preparation of the mother toner particles in Example 1 is repeated except that the toner constituent liquid is supplied to the head of the horn vibrator of the toner manufacturing device 1A illustrated in FIG. 4.

As "the thin film including plural holes", a nickel plate having an outer diameter of 8.0 mm and a thickness of 20 μm on which plural circular holes having an opening diameter of 10 μm are arranged is used. The holes are formed by electroforming. The holes are formed in the central region having a substantially circular shape having a diameter of about 5 mm, so that the distance between each of the holes is 100 μm (like hound's-tooth check). The number of the effective holes is about 1,000.

Liquid droplets of the toner constituent liquid are formed under the following conditions, and then the liquid droplets are dried to solidify.

Flow rate of dried air: 2.0 L/min (nitrogen gas for dispersion), 30.0 L/min (inner dried nitrogen gas)

Drying entrance temperature: 60° C.

Drying exit temperature: 45° C.

Dew-point temperature: −20° C.

Driving vibration frequency: 180 kHz

Thus, mother toner particles are prepared.

Although the mother toner particles are continuously produced for 5 hours, hole clogging never occurs.

The dried mother toner particles are suction-collected using a filter having 1 μm-sized fine pores. Next, 100 parts by weight of the mother toner particles are mixed with 1.0 parts by weight of a hydrophobized silica (H2000 from Clariant Japan K. K.) using a HENSCHEL MIXER (from Mitsui Mining Co., Ltd.). Thus, a black toner (a3) is prepared.

The toner (a3) has a very narrow particle diameter distribution such that the weight average particle diameter (D4) is 5.3 μm and the ratio (D4/Dn) is 1.02.

To evaluate resistance to hot offset and filming problem, a two-component developer (3) is prepared by mixing 4 parts of the toner (a3) and 96 parts of the magnetic carrier (A).

Example 10

The procedure for preparation of the toner and developer in Example 9 is repeated except that the carnauba wax is replaced with a synthesized ester wax (WEP-5 from NOF Corporation).

Example 11

The procedure for preparation of the toner and developer in Example 9 is repeated except that the carnauba wax is replaced with a paraffin wax (HNP-9 from Nippon Seiro Co., Ltd.).

Example 12

The procedure for preparation of the toner and developer in Example 9 is repeated except that the graft polymer (W-1) is replaced with the graft polymer (W-2).

Example 13

The procedure for preparation of the toner and developer in Example 9 is repeated except that the graft polymer (W-1) is replaced with the graft polymer (W-3).

Example 14

The procedure for preparation of the toner and developer in Example 9 is repeated except that the amount of the graft polymer (W-1) is changed to 1 part.

Example 15

The procedure for preparation of the toner and developer in Example 9 is repeated except that the amount of the graft polymer (W-1) is changed to 15 parts.

Comparative Example 5

The procedure for preparation of the toner and developer in Example 8 is repeated except that the carnauba wax and the graft polymer (W-1) are not added, and the amount of the polyester resin is changed to 200 parts.

Comparative Example 6

The procedure for preparation of the toner and developer in Example 8 is repeated except that the graft polymer (W-1) is not added, and the amount of the polyester resin is changed to 196 parts.

Comparative Example 7

The procedure for preparation of the toner and developer in Example 9 is repeated except that the graft polymer (W-1) is not added, and the amount of the polyester resin is changed to 196 parts.

Comparative Example 8

The procedure for preparation of the toner and developer in Example 10 is repeated except that the graft polymer (W-1) is not added, and the amount of the polyester resin is changed to 196 parts.

Comparative Example 9

The procedure for preparation of the toner and developer in Example 11 is repeated except that the graft polymer (W-1) is not added, and the amount of the polyester resin is changed to 196 parts.

Evaluation

The toners and developers prepared above are subjected to the following evaluations.

Particle Diameter

The weight average particle diameter (D4) and the number average particle diameter (Dn) of a toner are determined using a particle size analyzer COULTER MULTISIZER III (from Beckman Coulter K. K.) with an aperture having a diameter of 100 μm and an analysis software (Beckman Coulter Multisizer 3 Version 3.51).

The measuring method is as follows:

(1) 0.5 ml of a 10% by weight aqueous solution of a surfactant (an alkylbenzene sulfonate NEOGEN SC-A from Dai-ichi Kogyo Seiyaku Co., Ltd.) is contained in a 100 ml glass beaker;

(2) 0.5 g of a toner is added thereto and mixed using a microspatula, and then 80 ml of ion-exchanged water is added thereto to prepare a toner dispersion;

(3) the toner dispersion is subjected to a dispersing treatment using an ultrasonic dispersing machine (W-113MK-II from Honda Electronics Co., Ltd.) for 10 minutes;

(4) the toner dispersion is subjected to a measurement using the instrument COULTER MULTISIZER with using ISOTON III (from Beckman Coulter K. K.) as a measurement liquid, by adding the toner dispersion so that the instrument indicates a toner concentration of from 6 to 10%; and (5) the volume and number distribution are calculated by measuring the volume and number of toner particles, and then the weight particle diameter (D4) and the number average particle diameter (Dn) are determined.

It is important that the measurement toner concentration is from 6 to 10% from the viewpoint of reproducibility of the measurement.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, particles having a particle diameter of from not less than 2.00 μm to less than 40.30 μm can be measured.

The ratio (D4/Dn) of the weight particle diameter (D4) to the number average particle diameter (Dn) can be treated as an indicator of the particle diameter distribution. When the ratio (D4/Dn) is 1, the particle diameter distribution is monodisperse. The larger ratio (D4/Dn) a toner has, the wider particle diameter distribution the toner has.

Hot Offset Resistance

A developer is set in a copier (IMAGIO NEO 455 from Ricoh Co., Ltd.). Images are produced on a paper TYPE 6000 (from Ricoh Co., Ltd.) while varying the fixing temperature from a low temperature to a high temperature. A temperature at which the glossiness of an image decreases or offset is observed is defined as "offset occurrence temperature", and evaluated as follows.

Good: The offset occurrence temperature is not less than 200° C.

Poor: The offset occurrence temperature is less than 200° C.

Filming Resistance

A developer is set in a copier (IMAGIO NEO 455 from Ricoh Co., Ltd.). A running test in which an image having an image proportion of 7% is continuously produced is performed using a paper TYPE 6000 (from Ricoh Co., Ltd.). Whether or not the filming problem occurred is evaluated by observing the photoreceptor (whether or not a toner film is formed) and the produced image (whether or not the density unevenness is observed in halftone image), immediately after the 20,000$^{th}$, 50,000$^{th}$, and 10,0000$^{th}$ images are produced, and evaluated as follows.

Good: The filming problem does not occur even after 10,0000$^{th}$ image is produced.

Average: The filming problem occurs when 50,000$^{th}$ image is produced.

Poor: The filming problem occurs when 20,000$^{th}$ image is produced.

The evaluation results are shown in Tables 1 and 2.

TABLE 1

| | Hole Clogging | D4 (μm) | D4/Dn | Hot Offset Resistance | Filming Resistance |
|---|---|---|---|---|---|
| Ex. 1 | Good | 5.9 | 1.00 | Good | Good |
| Ex. 2 | Good | 59. | 1.00 | Good | Good |
| Ex. 3 | Good | 5.8 | 1.00 | Good | Good |
| Ex. 4 | Good | 6.0 | 1.01 | Good | Good |
| Ex. 5 | Good | 5.8 | 1.00 | Good | Good |
| Ex. 6 | Good | 5.7 | 1.02 | Good | Average |
| Ex. 7 | Good | 6.2 | 1.00 | Good | Good |
| Comp. Ex. 1 | Good | 6.1 | 1.00 | Poor | Good |
| Comp. Ex. 2 | Poor | 5.8 | 1.08 | Good | Poor |
| Comp. Ex. 3 | Poor | 5.7 | 1.06 | Good | Poor |
| Comp. Ex. 4 | Poor | 5.8 | 1.05 | Good | Poor |

TABLE 2

| | Hole Clogging | D4 (μm) | D4/Dn | Hot Offset Resistance | Filming Resistance |
|---|---|---|---|---|---|
| Ex. 8 | Good | 5.3 | 1.02 | Good | Good |
| Ex. 9 | Good | 5.3 | 1.02 | Good | Good |
| Ex. 10 | Good | 5.3 | 1.02 | Good | Good |
| Ex. 11 | Good | 5.2 | 1.03 | Good | Good |
| Ex. 12 | Good | 5.4 | 1.03 | Good | Good |

TABLE 2-continued

| | Hole Clogging | D4 (μm) | D4/Dn | Hot Offset Resistance | Filming Resistance |
|---|---|---|---|---|---|
| Ex. 13 | Good | 5.2 | 1.02 | Good | Good |
| Ex. 14 | Good | 5.1 | 1.04 | Good | Average |
| Ex. 15 | Good | 5.6 | 1.02 | Good | Good |
| Comp. Ex. 5 | Good | 5.5 | 1.02 | Poor | Good |
| Comp. Ex. 6 | Poor | 5.2 | 1.20 | Good | Poor |
| Comp. Ex. 7 | Poor | 5.2 | 1.18 | Good | Poor |
| Comp. Ex. 8 | Poor | 5.1 | 1.17 | Good | Poor |
| Comp. Ex. 9 | Poor | 5.2 | 1.21 | Good | Poor |

This document claims priority and contains subject matter related to Japanese Patent Applications Nos. 2006-242287 and 2007-184330, filed on Sep. 7, 2006 and Jul. 13, 2007, respectively, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method for manufacturing a toner, comprising:

dissolving or dispersing toner constituents comprising a resin, a colorant, a release agent, and a graft polymer comprising a polyolefin resin unit and a vinyl resin unit in a solvent, to prepare a toner constituent liquid;

supplying the toner constituent liquid to a retention part configured to retain the toner constituent liquid;

discharging the toner constituent liquid from the retention part to a granulation space through plural holes arranged on the retention part, while exciting the toner constituent liquid by a vibration means in contact with a part of the retention part, so that the discharged columnar toner constituent liquid is constricted to form liquid droplets; and converting the liquid droplets into solid toner particles.

2. The method for manufacturing a toner according to claim 1, wherein the solvent is an organic solvent, and the liquid droplets are converted into the solid toner particles by removing the organic solvent from the liquid droplets.

3. The method for manufacturing a toner according to claim 1, wherein the polyolefin resin has a softening point of from 70 to 150° C.

4. The method for manufacturing a toner according to claim 1, wherein the vinyl resin has an SP value of from 10.0 to 11.5 $(cal/cm^3)^{1/2}$.

5. The method for manufacturing a toner according to claim 1, wherein the toner constituent liquid comprises the graft polymer in an amount of from 10 to 150 parts by weight based on 100 parts by weight of the release agent.

6. The method for manufacturing a toner according to claim 1, wherein the vinyl resin comprises at least one member selected from the group consisting of a styrene unit, an alkyl acrylate unit, an alkyl methacrylate unit, an acrylonitrile unit, and a methacrylonitrile unit.

7. The method for manufacturing a toner according to claim 1, further comprising:

heating a mixture liquid comprising the release agent, the solvent, and the graft polymer so that the release agent is dissolved;

cooling the mixture liquid so that the release agent are precipitated out in a form of particles; and further pulverizing the particles of the release agent.

8. The method for manufacturing a toner according to claim 1, wherein each of the holes has an opening diameter of from 1 to 40 μm.

9. A method for manufacturing a toner, comprising:

dissolving or dispersing toner constituents comprising a resin, a colorant, a release agent, and a graft polymer comprising a polyolefin resin unit and a vinyl resin unit in a solvent, to prepare a toner constituent liquid;

supplying the toner constituent liquid to a retention part configured to retain the toner constituent liquid;

periodically discharging the toner constituent liquid from the retention part through plural holes arranged on a thin film provided on the retention part, while vibrating the thin film by a mechanical vibration means, so that liquid droplets are formed; and converting the liquid droplets into solid toner particles, wherein the mechanical vibration means comprises a circular vibration generating means provided surrounding the holes arranged on the thin film.

10. The method for manufacturing a toner according to claim 9, wherein the mechanical vibration means vibrates at a frequency of not less than 20 kHz and less than 2.0 MHz.

11. The method for manufacturing a toner according to claim 9, wherein the solvent is an organic solvent, and the liquid droplets are converted into the solid toner particles by removing the organic solvent from the liquid droplets.

12. The method for manufacturing a toner according to claim 9, wherein the polyolefin resin has a softening point of from 70 to 150° C.

13. The method for manufacturing a toner according to claim 9, wherein the vinyl resin has an SP value of from 10.0 to 11.5 $(cal/cm^3)^{1/2}$.

14. The method for manufacturing a toner according to claim 9, wherein the toner constituent liquid comprises the graft polymer in an amount of from 10 to 150 parts by weight based on 100 parts by weight of the release agent.

15. The method for manufacturing a toner according to claim 9, wherein the vinyl resin comprises at least one member selected from the group consisting of a styrene unit, an alkyl acrylate unit, an alkyl methacrylate unit, an acrylonitrile unit, and a methacrylonitrile unit.

16. The method for manufacturing a toner according to claim 9, further comprising:

heating a mixture liquid comprising the release agent, the solvent, and the graft polymer so that the release agent is dissolved;

cooling the mixture liquid so that the release agent are precipitated out in a form of particles; and further pulverizing the particles of the release agent.

17. The method for manufacturing a toner according to claim 9, wherein each of the holes has an opening diameter of from 1 to 40 μm.

18. A method for manufacturing a toner, comprising:

dissolving or dispersing toner constituents comprising a resin, a colorant, a release agent, and a graft polymer comprising a polyolefin resin unit and a vinyl resin unit in a solvent, to prepare a toner constituent liquid;

supplying the toner constituent liquid to a retention part configured to retain the toner constituent liquid;

periodically discharging the toner constituent liquid from the retention part through plural holes arranged on a thin film provided on the retention part, while vibrating the thin film by a mechanical vibration means, so that liquid droplets are formed; and converting the liquid droplets into solid toner particles, wherein the mechanical vibration means comprises a vibration means comprising a vibrating surface provided parallel to the thin film and vibrates in a vertical direction.

19. The method for manufacturing a toner according to claim 18, wherein the mechanical vibration means vibrates at a frequency of not less than 20 kHz and less than 2.0 MHz.

20. The method for manufacturing a toner according to claim 18, wherein the mechanical vibration means is a horn vibrator.

21. The method for manufacturing a toner according to claim 18, wherein the solvent is an organic solvent, and the liquid droplets are converted into the solid toner particles by removing the organic solvent from the liquid droplets.

22. The method for manufacturing a toner according to claim 18, wherein the polyolefin resin has a softening point of from 70 to 150° C.

23. The method for manufacturing a toner according to claim 18, wherein the vinyl resin has an SP value of from 10.0 to 11.5 $(cal/cm^3)^{1/2}$.

24. The method for manufacturing a toner according to claim 18, wherein the toner constituent liquid comprises the graft polymer in an amount of from 10 to 150 parts by weight based on 100 parts by weight of the release agent.

25. The method for manufacturing a toner according to claim 18, wherein the vinyl resin comprises at least one member selected from the group consisting of a styrene unit, an alkyl acrylate unit, an alkyl methacrylate unit, an acrylonitrile unit, and a methacrylonitrile unit.

26. The method for manufacturing a toner according to claim 18, further comprising:

heating a mixture liquid comprising the release agent, the solvent, and the graft polymer so that the release agent is dissolved;

cooling the mixture liquid so that the release agent are precipitated out in a form of particles; and further pulverizing the particles of the release agent.

27. The method for manufacturing a toner according to claim 18, wherein each of the holes has an opening diameter of from 1 to 40 μm.

* * * * *